US009017101B2

(12) United States Patent
Ehret et al.

(10) Patent No.: US 9,017,101 B2
(45) **Date of Patent: *Apr. 28, 2015**

(54) CONTINUITY MAINTAINING BIASING MEMBER

(71) Applicant: PPC Broadband, Inc., East Syracuse, NY (US)

(72) Inventors: Trevor Ehret, North Haven, CT (US); Richard A. Haube, Cazenovia, NY (US); Noah Montena, Syracuse, NY (US); Souheil Zraik, Liverpool, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/758,586

(22) Filed: Feb. 4, 2013

(65) Prior Publication Data

US 2013/0183857 A1 Jul. 18, 2013

Related U.S. Application Data

(63) Continuation-in-part of application No. 13/075,406, filed on Mar. 30, 2011, now Pat. No. 8,366,481.

(51) Int. Cl.

| | |
|---|---|
| ***H01R 9/05*** | (2006.01) |
| ***H01R 43/00*** | (2006.01) |
| ***H01R 13/52*** | (2006.01) |

(52) U.S. Cl.

CPC ..... *H01R 9/05* (2013.01); *H01R 43/00* (2013.01); *H01R 13/5202* (2013.01); *H01R 9/0524* (2013.01)

(58) Field of Classification Search

USPC ..... 439/578–584

See application file for complete search history.

(56) References Cited

U.S. PATENT DOCUMENTS

| | | | |
|---|---|---|---|
| 331,169 | A | 11/1885 | Thomas |
| 1,371,742 | A | 3/1921 | Dringman |

(Continued)

FOREIGN PATENT DOCUMENTS

| | | | |
|---|---|---|---|
| CA | 2096710.00 | A1 | 11/1994 |
| CA | 2096710 | A1 | 11/1994 |

(Continued)

OTHER PUBLICATIONS

Digicon AVL Connector. ARRIS Group Inc. [online]. 3 pages. [retrieved on Apr. 22, 2010]. Retrieved from the Internet<URL: http://www.arrisi.com/special/digiconAVL.asp>.

(Continued)

*Primary Examiner* — Briggitte R Hammond
(74) *Attorney, Agent, or Firm* — Hiscock & Barclay LLP

(57) ABSTRACT

A coaxial cable connector comprising a post, a coupling element configured to engage the post, and a connector body configured to engage the post and receive the coaxial cable, when the connector is in an assembled state, the connector body including: an integral body biasing element having a coupling element contact portion, and an annular groove configured to allow the integral body biasing element to deflect along the axial direction, wherein the integral body biasing element is configured to exert a biasing force against the coupling element sufficient to axially urge the inward lip of the coupling element away from the connector body and toward the flange of the post to improve electrical grounding reliability between the coupling element and the post, even when the post is not in contact with the interface port is provided. Furthermore, an associated method is also provided.

159 Claims, 19 Drawing Sheets

(56) References Cited

U.S. PATENT DOCUMENTS

| | | | |
|---|---|---|---|
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 2,013,526 | A | 9/1935 | Schmitt |
| 2,102,495 | A | 12/1937 | England |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,665,729 | A | 1/1954 | Terry |
| 2,694,187 | A | 11/1954 | Nash |
| 2,694,817 | A | 11/1954 | Roderick |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,816,949 | A | 12/1957 | Curtiss |
| 2,870,420 | A | 1/1959 | Malek |
| 3,001,169 | A | 9/1961 | Blonder |
| 3,015,794 | A | 1/1962 | Kishbaugh |
| 3,091,748 | A | 5/1963 | Takes et al. |
| 3,094,364 | A | 6/1963 | Lingg |
| 3,184,706 | A | 5/1965 | Atkins |
| 3,194,292 | A | 7/1965 | Borowsky |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,494,400 | A | 2/1970 | McCoy et al. |
| 3,498,647 | A | 3/1970 | Schroder |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,444 | A | 7/1972 | Stevens et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,858,156 | A | 12/1974 | Zarro |
| 3,870,978 | A | 3/1975 | Dreyer |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,960,428 | A | 6/1976 | Naus et al. |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,017,139 | A | 4/1977 | Nelson |
| 4,022,966 | A | 5/1977 | Gajajiva |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,109,126 | A | 8/1978 | Halbeck |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,193,655 | A | 3/1980 | Herrmann, Jr. |
| 4,194,338 | A | 3/1980 | Trafton |
| 4,213,664 | A | 7/1980 | McClenan |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann et al. |
| 4,307,926 | A | 12/1981 | Smith |
| 4,322,121 | A | 3/1982 | Riches et al. |
| 4,326,769 | A | 4/1982 | Dorsey et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,359,254 | A | 11/1982 | Gallusser |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |

(56) References Cited

U.S. PATENT DOCUMENTS

| | | | |
|---|---|---|---|
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,490,576 | A | 12/1984 | Bolante et al. |
| 4,506,943 | A | 3/1985 | Drogo |
| 4,515,427 | A | 5/1985 | Smit |
| 4,525,017 | A | 6/1985 | Schildkraut et al. |
| 4,531,790 | A | 7/1985 | Selvin |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,597,621 | A | 7/1986 | Burns |
| 4,598,959 | A | 7/1986 | Selvin |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,655,534 | A | 4/1987 | Stursa |
| 4,660,921 | A | 4/1987 | Hauver |
| 4,668,043 | A | 5/1987 | Saba et al. |
| 4,673,236 | A | 6/1987 | Musolff et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,690,482 | A | 9/1987 | Chamberland et al. |
| 4,691,976 | A | 9/1987 | Cowen |
| 4,703,987 | A | 11/1987 | Gallusser et al. |
| 4,703,988 | A | 11/1987 | Raux et al. |
| 4,717,355 | A | 1/1988 | Mattis |
| 4,720,155 | A | 1/1988 | Schildkraut et al. |
| 4,734,050 | A | 3/1988 | Negre et al. |
| 4,734,666 | A | 3/1988 | Ohya et al. |
| 4,737,123 | A | 4/1988 | Paler et al. |
| 4,738,009 | A | 4/1988 | Down et al. |
| 4,738,628 | A | 4/1988 | Rees |
| 4,739,126 | A | 4/1988 | Gutter et al. |
| 4,746,305 | A | 5/1988 | Nomura |
| 4,747,786 | A | 5/1988 | Hayashi et al. |
| 4,749,821 | A | 6/1988 | Linton et al. |
| 4,755,152 | A | 7/1988 | Elliot et al. |
| 4,757,297 | A | 7/1988 | Frawley |
| 4,759,729 | A | 7/1988 | Kemppainen et al. |
| 4,761,146 | A | 8/1988 | Sohoel |
| 4,772,222 | A | 9/1988 | Laudig et al. |
| 4,789,355 | A | 12/1988 | Lee |
| 4,789,759 | A | 12/1988 | Jones |
| 4,795,360 | A | 1/1989 | Newman et al. |
| 4,797,120 | A | 1/1989 | Ulery |
| 4,806,116 | A | 2/1989 | Ackerman |
| 4,807,891 | A | 2/1989 | Neher |
| 4,808,128 | A | 2/1989 | Werth |
| 4,813,886 | A | 3/1989 | Roos et al. |
| 4,820,185 | A | 4/1989 | Moulin |
| 4,834,675 | A | 5/1989 | Samchisen |
| 4,835,342 | A | 5/1989 | Guginsky |
| 4,836,801 | A | 6/1989 | Ramirez |
| 4,838,813 | A | 6/1989 | Pauza et al. |
| 4,854,893 | A | 8/1989 | Morris |
| 4,857,014 | A | 8/1989 | Alf et al. |
| 4,867,706 | A | 9/1989 | Tang |
| 4,869,679 | A | 9/1989 | Szegda |
| 4,874,331 | A | 10/1989 | Iverson |
| 4,892,275 | A | 1/1990 | Szegda |
| 4,902,246 | A | 2/1990 | Samchisen |
| 4,906,207 | A | 3/1990 | Banning et al. |
| 4,915,651 | A | 4/1990 | Bout |
| 4,921,447 | A | 5/1990 | Capp et al. |
| 4,923,412 | A | 5/1990 | Morris |
| 4,925,403 | A | 5/1990 | Zorzy |
| 4,927,385 | A | 5/1990 | Cheng |
| 4,929,188 | A | 5/1990 | Lionetto et al. |
| 4,934,960 | A | 6/1990 | Capp et al. |
| 4,938,718 | A | 7/1990 | Guendel |
| 4,941,846 | A | 7/1990 | Guimond et al. |
| 4,952,174 | A | 8/1990 | Sucht et al. |
| 4,957,456 | A | 9/1990 | Olson et al. |
| 4,973,265 | A | 11/1990 | Heeren |
| 4,979,911 | A | 12/1990 | Spencer |
| 4,990,104 | A | 2/1991 | Schieferly |
| 4,990,105 | A | 2/1991 | Karlovich |
| 4,990,106 | A | 2/1991 | Szegda |
| 4,992,061 | A | 2/1991 | Brush, Jr. et al. |
| 5,002,503 | A | 3/1991 | Campbell et al. |
| 5,007,861 | A | 4/1991 | Stirling |
| 5,011,422 | A | 4/1991 | Yeh |
| 5,011,432 | A | 4/1991 | Sucht et al. |
| 5,021,010 | A | 6/1991 | Wright |
| 5,024,606 | A | 6/1991 | Ming-Hwa |
| 5,030,126 | A | 7/1991 | Hanlon |
| 5,037,328 | A | 8/1991 | Karlovich |
| 5,046,964 | A | 9/1991 | Welsh et al. |
| 5,052,947 | A | 10/1991 | Brodie et al. |
| 5,055,060 | A | 10/1991 | Down et al. |
| 5,059,747 | A | 10/1991 | Bawa et al. |
| 5,062,804 | A | 11/1991 | Jamet et al. |
| 5,066,248 | A | 11/1991 | Gaver, Jr. et al. |
| 5,073,129 | A | 12/1991 | Szegda |
| 5,080,600 | A | 1/1992 | Baker et al. |
| 5,083,943 | A | 1/1992 | Tarrant |
| 5,120,260 | A | 6/1992 | Jackson |
| 5,127,853 | A | 7/1992 | McMills et al. |
| 5,131,862 | A | 7/1992 | Gershfeld |
| 5,137,470 | A | 8/1992 | Doles |
| 5,137,471 | A | 8/1992 | Verespej et al. |
| 5,141,448 | A | 8/1992 | Mattingly et al. |
| 5,141,451 | A | 8/1992 | Down |
| 5,149,274 | A | 9/1992 | Gallusser et al. |
| 5,154,636 | A | 10/1992 | Vaccaro et al. |
| 5,161,993 | A | 11/1992 | Leibfried, Jr. |
| 5,166,477 | A | 11/1992 | Perin, Jr. et al. |
| 5,169,323 | A | 12/1992 | Kawai et al. |
| 5,181,161 | A | 1/1993 | Hirose et al. |
| 5,183,417 | A | 2/1993 | Bools |
| 5,186,501 | A | 2/1993 | Mano |
| 5,186,655 | A | 2/1993 | Glenday et al. |
| 5,195,905 | A | 3/1993 | Pesci |
| 5,195,906 | A | 3/1993 | Szegda |
| 5,205,547 | A | 4/1993 | Mattingly |
| 5,205,761 | A | 4/1993 | Nilsson |
| 5,207,602 | A | 5/1993 | McMills et al. |
| 5,215,477 | A | 6/1993 | Weber et al. |

(56) References Cited

U.S. PATENT DOCUMENTS

| | | | |
|---|---|---|---|
| 5,217,391 | A | 6/1993 | Fisher, Jr. |
| 5,217,393 | A | 6/1993 | Del Negro et al. |
| 5,221,216 | A | 6/1993 | Gabany et al. |
| 5,227,587 | A | 7/1993 | Paterek |
| 5,247,424 | A | 9/1993 | Harris et al. |
| 5,269,701 | A | 12/1993 | Leibfried, Jr. |
| 5,283,853 | A | 2/1994 | Szegda |
| 5,284,449 | A | 2/1994 | Vaccaro |
| 5,294,864 | A | 3/1994 | Do |
| 5,295,864 | A | 3/1994 | Birch et al. |
| 5,316,494 | A | 5/1994 | Flanagan et al. |
| 5,318,459 | A | 6/1994 | Shields |
| 5,321,205 | A | 6/1994 | Bawa et al. |
| 5,334,032 | A | 8/1994 | Myers et al. |
| 5,334,051 | A | 8/1994 | Devine et al. |
| 5,338,225 | A | 8/1994 | Jacobsen et al. |
| 5,342,218 | A | 8/1994 | McMills et al. |
| 5,354,217 | A | 10/1994 | Gabel et al. |
| 5,362,250 | A | 11/1994 | McMills et al. |
| 5,371,819 | A | 12/1994 | Szegda |
| 5,371,821 | A | 12/1994 | Szegda |
| 5,371,827 | A | 12/1994 | Szegda |
| 5,380,211 | A | 1/1995 | Kawaguchi et al. |
| 5,389,005 | A | 2/1995 | Kodama |
| 5,393,244 | A | 2/1995 | Szegda |
| 5,397,252 | A | 3/1995 | Wang |
| 5,413,504 | A | 5/1995 | Kloecker et al. |
| 5,431,583 | A | 7/1995 | Szegda |
| 5,435,745 | A | 7/1995 | Booth |
| 5,435,751 | A | 7/1995 | Papenheim et al. |
| 5,439,386 | A | 8/1995 | Ellis et al. |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |
| 5,466,173 | A | 11/1995 | Down |
| 5,470,257 | A | 11/1995 | Szegda |
| 5,474,478 | A | 12/1995 | Ballog |
| 5,490,033 | A | 2/1996 | Cronin |
| 5,490,801 | A | 2/1996 | Fisher, Jr. et al. |
| 5,494,454 | A | 2/1996 | Johnsen |
| 5,499,934 | A | 3/1996 | Jacobsen et al. |
| 5,501,616 | A | 3/1996 | Holliday |
| 5,509,823 | A | 4/1996 | Harting et al. |
| 5,516,303 | A | 5/1996 | Yohn et al. |
| 5,525,076 | A | 6/1996 | Down |
| 5,542,861 | A | 8/1996 | Anhalt et al. |
| 5,548,088 | A | 8/1996 | Gray et al. |
| 5,550,521 | A | 8/1996 | Bernaud et al. |
| 5,564,938 | A | 10/1996 | Shenkal et al. |
| 5,571,028 | A | 11/1996 | Szegda |
| 5,586,910 | A | 12/1996 | Del Negro et al. |
| 5,595,499 | A | 1/1997 | Zander et al. |
| 5,598,132 | A | 1/1997 | Stabile |
| 5,607,325 | A | 3/1997 | Toma |
| 5,620,339 | A | 4/1997 | Gray et al. |
| 5,632,637 | A | 5/1997 | Diener |
| 5,632,651 | A | 5/1997 | Szegda |
| 5,644,104 | A | 7/1997 | Porter et al. |
| 5,651,698 | A | 7/1997 | Locati et al. |
| 5,651,699 | A | 7/1997 | Holliday |
| 5,653,605 | A | 8/1997 | Woehl et al. |
| 5,667,405 | A | 9/1997 | Holliday |
| 5,681,172 | A | 10/1997 | Moldenhauer |
| 5,683,263 | A | 11/1997 | Hsu |
| 5,702,263 | A | 12/1997 | Baumann et al. |
| 5,722,856 | A | 3/1998 | Fuchs et al. |
| 5,735,704 | A | 4/1998 | Anthony |
| 5,746,617 | A | 5/1998 | Porter, Jr. et al. |
| 5,746,619 | A | 5/1998 | Harting et al. |
| 5,769,652 | A | 6/1998 | Wider |
| 5,775,927 | A | 7/1998 | Wider |
| 5,863,220 | A | 1/1999 | Holliday |
| 5,877,452 | A | 3/1999 | McConnell |
| 5,879,191 | A | 3/1999 | Burris |
| 5,882,226 | A | 3/1999 | Bell et al. |
| 5,897,795 | A | 4/1999 | Lu et al. |
| 5,921,793 | A | 7/1999 | Phillips |
| 5,938,465 | A | 8/1999 | Fox, Sr. |
| 5,944,548 | A | 8/1999 | Saito |
| 5,951,327 | A | 9/1999 | Marik |
| 5,957,716 | A | 9/1999 | Buckley et al. |
| 5,967,852 | A | 10/1999 | Follingstad et al. |
| 5,975,949 | A | 11/1999 | Holliday et al. |
| 5,975,951 | A | 11/1999 | Burris et al. |
| 5,977,841 | A | 11/1999 | Lee et al. |
| 5,997,350 | A | 12/1999 | Burris et al. |
| 6,010,349 | A | 1/2000 | Porter, Jr. |
| 6,019,635 | A | 2/2000 | Nelson |
| 6,022,237 | A | 2/2000 | Esh |
| 6,032,358 | A | 3/2000 | Wild |
| 6,042,422 | A | 3/2000 | Youtsey |
| 6,048,229 | A | 4/2000 | Lazaro, Jr. |
| 6,053,743 | A | 4/2000 | Mitchell et al. |
| 6,053,769 | A | 4/2000 | Kubota et al. |
| 6,053,777 | A | 4/2000 | Boyle |
| 6,083,053 | A | 7/2000 | Anderson, Jr. et al. |
| 6,089,903 | A | 7/2000 | Stafford Gray et al. |
| 6,089,912 | A | 7/2000 | Tallis et al. |
| 6,089,913 | A | 7/2000 | Holliday |
| 6,123,567 | A | 9/2000 | McCarthy |
| 6,146,197 | A | 11/2000 | Holliday et al. |
| 6,152,753 | A | 11/2000 | Johnson et al. |
| 6,153,830 | A | 11/2000 | Montena |
| 6,162,995 | A | 12/2000 | Bachle et al. |
| 6,210,216 | B1 | 4/2001 | Tso-Chin et al. |
| 6,210,222 | B1 | 4/2001 | Langham et al. |
| 6,217,383 | B1 | 4/2001 | Holland et al. |
| 6,239,359 | B1 | 5/2001 | Lilienthal, II et al. |
| 6,241,553 | B1 | 6/2001 | Hsia |
| 6,257,923 | B1 | 7/2001 | Stone et al. |
| 6,261,126 | B1 | 7/2001 | Stirling |
| 6,267,612 | B1 | 7/2001 | Arcykiewicz et al. |
| 6,271,464 | B1 | 8/2001 | Cunningham |
| 6,331,123 | B1 | 12/2001 | Rodrigues |
| 6,332,815 | B1 | 12/2001 | Bruce |
| 6,358,077 | B1 | 3/2002 | Young |
| 6,383,019 | B1 | 5/2002 | Wild |
| D458,904 | S | 6/2002 | Montena |
| 6,406,330 | B2 | 6/2002 | Bruce |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| 6,439,899 | B1 | 8/2002 | Muzslay et al. |
| D462,327 | S | 9/2002 | Montena |
| 6,468,100 | B1 | 10/2002 | Meyer et al. |
| 6,491,546 | B1 | 12/2002 | Perry |
| D468,696 | S | 1/2003 | Montena |
| 6,506,083 | B1 | 1/2003 | Bickford et al. |
| 6,520,800 | B1 | 2/2003 | Michelbach et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,634,906 | B1 | 10/2003 | Yeh |
| 6,676,446 | B2 | 1/2004 | Montena |
| 6,683,253 | B1 | 1/2004 | Lee |
| 6,692,285 | B2 | 2/2004 | Islam |
| 6,692,286 | B1 | 2/2004 | De Cet |
| 6,705,884 | B1 | 3/2004 | McCarthy |
| 6,709,280 | B1 | 3/2004 | Gretz |
| 6,712,631 | B1 | 3/2004 | Youtsey |
| 6,716,041 | B2 | 4/2004 | Ferderer et al. |

(56) References Cited

U.S. PATENT DOCUMENTS 6,716,062 B1 4/2004 Palinkas et al.
6,733,336 B1 5/2004 Montena et al.
6,733,337 B2 5/2004 Kodaira
6,752,633 B2 6/2004 Aizawa et al.
6,767,248 B1 7/2004 Hung
6,769,926 B1 8/2004 Montena
6,769,933 B2 8/2004 Bence et al.
6,780,029 B1 8/2004 Gretz
6,780,052 B2 8/2004 Montena et al.
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,817,897 B2 11/2004 Chee
6,848,939 B2 2/2005 Stirling
6,848,940 B2 2/2005 Montena
6,873,864 B2 3/2005 Kai et al.
6,882,247 B2 4/2005 Allison et al.
6,884,113 B1 4/2005 Montena
6,884,115 B2 4/2005 Malloy
6,898,940 B2 5/2005 Gram et al.
6,916,200 B2 7/2005 Burris et al.
6,929,265 B2 8/2005 Holland et al.
6,929,508 B1 8/2005 Holland
6,939,169 B2 9/2005 Islam et al.
6,948,976 B2 9/2005 Goodwin et al.
6,971,912 B2 12/2005 Montena et al.
7,004,788 B2 2/2006 Montena
7,011,547 B1 3/2006 Wu
7,029,304 B2 4/2006 Montena
7,029,326 B2 4/2006 Montena
7,063,565 B2 6/2006 Ward
7,070,447 B1 7/2006 Montena
7,074,081 B2 7/2006 Hsia
7,086,897 B2 8/2006 Montena
7,097,499 B1 8/2006 Purdy
7,097,500 B2 8/2006 Montena
7,102,868 B2 9/2006 Montena
7,108,548 B2 9/2006 Burris et al.
7,114,990 B2 10/2006 Bence et al.
7,118,416 B2 10/2006 Montena et al.
7,125,283 B1 10/2006 Lin
7,128,603 B2 10/2006 Burris et al.
7,128,605 B2 10/2006 Montena
7,131,867 B1 11/2006 Foster et al.
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,179,121 B1 2/2007 Burris et al.
7,186,127 B2 3/2007 Montena
7,189,113 B2 3/2007 Sattele et al.
7,198,507 B2 4/2007 Tusini
7,207,820 B1 4/2007 Montena
7,229,303 B2 6/2007 Vermoesen et al.
7,241,172 B2 7/2007 Rodrigues et al.
7,252,546 B1 8/2007 Holland
7,255,598 B2 8/2007 Montena et al.
7,264,503 B2 9/2007 Montena
7,299,520 B2 11/2007 Huang
7,299,550 B2 11/2007 Montena
7,300,309 B2 11/2007 Montena
7,309,255 B2 12/2007 Rodrigues
7,354,309 B2 4/2008 Palinkas
7,371,112 B2 5/2008 Burris et al.
7,371,113 B2 5/2008 Burris et al.
7,375,533 B2 5/2008 Gale
7,393,245 B2 7/2008 Palinkas et al.
7,404,737 B1 7/2008 Youtsey
7,442,081 B2 10/2008 Burke et al.
7,452,237 B1 11/2008 Montena
7,452,239 B2 11/2008 Montena
7,455,549 B2 11/2008 Rodrigues et al.
7,455,550 B1 11/2008 Sykes
7,462,068 B2 12/2008 Amidon
7,476,127 B1 1/2009 Wei
7,479,033 B1 1/2009 Sykes et al.
7,479,035 B2 1/2009 Bence et al.
7,480,991 B2 1/2009 Khemakhem et al.
7,488,210 B1 2/2009 Burris et al.
7,494,355 B2 2/2009 Hughes et al.
7,497,729 B1 3/2009 Wei
7,507,117 B2 3/2009 Amidon
7,513,795 B1 4/2009 Shaw
7,544,094 B1 6/2009 Paglia et al.
7,566,236 B2 7/2009 Malloy et al.
7,568,945 B2 8/2009 Chee et al.
7,607,942 B1 10/2009 Van Swearingen
7,644,755 B2 1/2010 Stoesz et al.
7,674,132 B1 3/2010 Chen
7,682,177 B2 3/2010 Berthet
7,727,011 B2 6/2010 Montena et al.
7,753,705 B2 7/2010 Montena
7,753,727 B1 7/2010 Islam et al.
7,792,148 B2 9/2010 Carlson et al.
7,794,275 B2 9/2010 Rodrigues
7,798,849 B2 9/2010 Montena
7,806,714 B2 10/2010 Williams et al.
7,806,725 B1 10/2010 Chen
7,811,133 B2 10/2010 Gray
7,824,216 B2 11/2010 Purdy
7,828,595 B2 11/2010 Mathews
7,828,596 B2 11/2010 Malak
7,830,154 B2 11/2010 Gale
7,833,053 B2 11/2010 Mathews
7,837,501 B2 11/2010 Youtsey
7,845,963 B2 12/2010 Gastineau
7,845,976 B2 12/2010 Mathews
7,845,978 B1 12/2010 Chen
7,850,487 B1 12/2010 Wei
7,857,661 B1 12/2010 Islam
7,874,870 B1 1/2011 Chen
7,887,354 B2 2/2011 Holliday
7,892,004 B2 2/2011 Hertzler et al.
7,892,005 B2 2/2011 Haube
7,892,024 B1 2/2011 Chen
7,927,135 B1 4/2011 Wlos
7,934,954 B1 5/2011 Chawgo et al.
7,950,958 B2 5/2011 Mathews
7,955,126 B2 6/2011 Bence et al.
7,972,158 B2 7/2011 Wild et al.
8,029,315 B2 10/2011 Purdy et al.
8,033,862 B2 10/2011 Radzil et al.
8,062,044 B2 11/2011 Montena et al.
8,062,063 B2 11/2011 Malloy et al.
8,075,337 B2 12/2011 Malloy et al.
8,075,338 B1 12/2011 Montena
8,075,339 B2 12/2011 Holliday
8,079,860 B1 12/2011 Zraik
8,113,875 B2 2/2012 Malloy et al.
8,152,551 B2 4/2012 Zraik
8,157,588 B1 4/2012 Rodrigues et al.
8,157,589 B2 4/2012 Krenceski et al.
8,167,635 B1 5/2012 Mathews
8,167,636 B1 5/2012 Montena
8,167,646 B1 5/2012 Mathews
8,172,612 B2 5/2012 Bence et al.
8,186,919 B2 5/2012 Blair
8,192,237 B2 6/2012 Purdy et al.
8,206,176 B2 6/2012 Islam
8,231,406 B2 7/2012 Burris et al.
8,231,412 B2 7/2012 Paglia et al.
8,287,320 B2 10/2012 Purdy et al.
8,313,345 B2 11/2012 Purdy
8,313,353 B2 11/2012 Purdy et al.
8,323,053 B2 12/2012 Montena
8,323,060 B2 12/2012 Purdy et al.
8,328,577 B1 12/2012 Lu
8,337,229 B2 12/2012 Montena
8,348,697 B2 1/2013 Zraik
8,366,481 B2 2/2013 Ehret et al.
8,376,769 B2 2/2013 Holand et al.

(56) References Cited

U.S. PATENT DOCUMENTS

| | | | |
|---|---|---|---|
| 8,382,517 | B2 | 2/2013 | Mathews |
| 8,398,421 | B2 | 3/2013 | Haberek et al. |
| 8,414,322 | B2 | 4/2013 | Montena |
| 8,444,445 | B2 | 5/2013 | Amidon et al. |
| 8,469,740 | B2 | 6/2013 | Ehret et al. |
| 8,475,205 | B2 | 7/2013 | Ehret et al. |
| 8,480,430 | B2 | 7/2013 | Ehret et al. |
| 8,480,431 | B2 | 7/2013 | Ehret et al. |
| 8,485,845 | B2 | 7/2013 | Ehret et al. |
| 8,506,325 | B2 | 8/2013 | Malloy et al. |
| 8,517,763 | B2 | 8/2013 | Burris et al. |
| 8,529,279 | B2 | 9/2013 | Montena |
| 8,562,366 | B2 | 10/2013 | Purdy et al. |
| 8,597,041 | B2 | 12/2013 | Purdy et al. |
| 2002/0013088 | A1 | 1/2002 | Rodrigues et al. |
| 2002/0038720 | A1 | 4/2002 | Kai et al. |
| 2003/0068924 | A1 | 4/2003 | Montena |
| 2003/0214370 | A1 | 11/2003 | Allison et al. |
| 2003/0224657 | A1 | 12/2003 | Malloy |
| 2004/0013096 | A1 | 1/2004 | Marinier et al. |
| 2004/0077215 | A1 | 4/2004 | Palinkas et al. |
| 2004/0102089 | A1 | 5/2004 | Chee |
| 2004/0209516 | A1 | 10/2004 | Burris et al. |
| 2004/0219833 | A1 | 11/2004 | Burris et al. |
| 2004/0229504 | A1 | 11/2004 | Liu |
| 2005/0042919 | A1 | 2/2005 | Montena |
| 2005/0208827 | A1 | 9/2005 | Burris et al. |
| 2005/0233636 | A1 | 10/2005 | Rodrigues et al. |
| 2006/0099853 | A1 | 5/2006 | Sattele et al. |
| 2006/0110977 | A1 | 5/2006 | Mathews |
| 2006/0154519 | A1 | 7/2006 | Montena |
| 2006/0166552 | A1 | 7/2006 | Bence et al. |
| 2006/0205272 | A1 | 9/2006 | Rodgrguies |
| 2006/0276079 | A1 | 12/2006 | Chen |
| 2007/0026734 | A1 | 2/2007 | Bence et al. |
| 2007/0049113 | A1 | 3/2007 | Rodrigues et al. |
| 2007/0123101 | A1 | 5/2007 | Palinkas |
| 2007/0155232 | A1 | 7/2007 | Burris et al. |
| 2007/0175027 | A1 | 8/2007 | Khemakhem et al. |
| 2007/0243759 | A1 | 10/2007 | Rodrigues et al. |
| 2007/0243762 | A1 | 10/2007 | Burke et al. |
| 2008/0102696 | A1 | 5/2008 | Montena |
| 2008/0192674 | A1 | 8/2008 | Wang et al. |
| 2008/0225783 | A1 | 9/2008 | Wang et al. |
| 2008/0248689 | A1 | 10/2008 | Montena |
| 2008/0289470 | A1 | 11/2008 | Aston |
| 2009/0017803 | A1 | 1/2009 | Brillhart et al. |
| 2009/0029590 | A1 | 1/2009 | Sykes et al. |
| 2009/0098770 | A1 | 4/2009 | Bence et al. |
| 2009/0176396 | A1 | 7/2009 | Mathews |
| 2009/0186521 | A1 | 7/2009 | McMullen et al. |
| 2010/0055978 | A1 | 3/2010 | Montena |
| 2010/0081321 | A1 | 4/2010 | Malloy et al. |
| 2010/0081322 | A1 | 4/2010 | Malloy et al. |
| 2010/0105246 | A1 | 4/2010 | Burris et al. |
| 2010/0233901 | A1 | 9/2010 | Wild et al. |
| 2010/0233902 | A1 | 9/2010 | Youtsey |
| 2010/0255720 | A1 | 10/2010 | Radzik et al. |
| 2010/0255721 | A1 | 10/2010 | Purdy et al. |
| 2010/0279548 | A1 | 11/2010 | Montena et al. |
| 2010/0297871 | A1 | 11/2010 | Haube |
| 2010/0297875 | A1 | 11/2010 | Purdy |
| 2011/0021072 | A1 | 1/2011 | Purdy |
| 2011/0027039 | A1 | 2/2011 | Blair |
| 2011/0053413 | A1 | 3/2011 | Mathews |
| 2011/0086543 | A1 | 4/2011 | Alrutz |
| 2011/0111623 | A1 | 5/2011 | Burris et al. |
| 2011/0117774 | A1 | 5/2011 | Malloy et al. |
| 2011/0143567 | A1 | 6/2011 | Purdy et al. |
| 2011/0230089 | A1 | 9/2011 | Amidon et al. |
| 2011/0230091 | A1 | 9/2011 | Krenceski et al. |
| 2011/0250789 | A1 | 10/2011 | Burris et al. |
| 2012/0021642 | A1 | 1/2012 | Zraik |
| 2012/0040537 | A1 | 2/2012 | Burris |
| 2012/0045933 | A1 | 2/2012 | Youtsey |
| 2012/0094530 | A1 | 4/2012 | Montena |
| 2012/0094532 | A1 | 4/2012 | Montena |
| 2012/0122329 | A1 | 5/2012 | Montena et al. |
| 2012/0129387 | A1 | 5/2012 | Holland et al. |
| 2012/0145454 | A1 | 6/2012 | Montena |
| 2012/0171894 | A1 | 7/2012 | Malloy et al. |
| 2012/0196476 | A1 | 8/2012 | Haberek et al. |
| 2012/0202378 | A1 | 8/2012 | Krenceski et al. |
| 2012/0214342 | A1 | 8/2012 | Mathews |
| 2012/0222302 | A1 | 9/2012 | Purdy et al. |
| 2012/0225581 | A1 | 9/2012 | Amidon et al. |
| 2012/0252263 | A1 | 10/2012 | Ehret et al. |
| 2012/0270441 | A1 | 10/2012 | Bence et al. |
| 2013/0034983 | A1 | 2/2013 | Purdy et al. |
| 2013/0065433 | A1 | 3/2013 | Burris |
| 2013/0065435 | A1 | 3/2013 | Purdy et al. |
| 2013/0072059 | A1 | 3/2013 | Purdy et al. |
| 2013/0102188 | A1 | 4/2013 | Montena |
| 2013/0102189 | A1 | 4/2013 | Montena |
| 2013/0102190 | A1 | 4/2013 | Chastain et al. |
| 2013/0164975 | A1 | 6/2013 | Blake et al. |
| 2013/0171869 | A1 | 7/2013 | Chastain et al. |
| 2013/0171870 | A1 | 7/2013 | Chastain et al. |
| 2013/0183857 | A1 | 7/2013 | Ehret et al. |
| 2013/0337683 | A1 | 12/2013 | Chastain et al. |

FOREIGN PATENT DOCUMENTS

| | | | |
|---|---|---|---|
| CN | 101060690.00 | A | 10/2007 |
| CN | 201149936.00 | Y | 11/2008 |
| CN | 201149936 | Y | 11/2008 |
| CN | 201149937.00 | Y | 11/2008 |
| CN | 201149937 | Y | 11/2008 |
| CN | 201178228.00 | Y | 1/2009 |
| CN | 201178228 | Y | 1/2009 |
| CN | 201904508.00 | | 7/2011 |
| DE | 47931.00 | C | 10/1888 |
| DE | 47931 | C | 10/1888 |
| DE | 102289.00 | C | 4/1899 |
| DE | 102289 | C | 4/1899 |
| DE | 1117687.00 | B | 11/1961 |
| DE | 1117687 | B | 11/1961 |
| DE | 1191880 | | 4/1965 |
| DE | 1191880.00 | | 4/1965 |
| DE | 1515398.00 | B1 | 4/1970 |
| DE | 1515398 | B1 | 4/1970 |
| DE | 2225764.00 | A1 | 12/1972 |
| DE | 2225764 | A1 | 12/1972 |
| DE | 2221936.00 | A1 | 11/1973 |
| DE | 2221936 | A1 | 11/1973 |
| DE | 2261973.00 | A1 | 6/1974 |
| DE | 2261973 | A1 | 6/1974 |
| DE | 3211008.00 | A1 | 10/1983 |
| DE | 3211008 | A1 | 10/1983 |
| DE | 9001608.4 | U1 | 4/1990 |
| DE | 9001608.40 | U1 | 4/1990 |
| DE | 4439852.00 | A1 | 5/1996 |
| DE | 4439852 | A1 | 5/1996 |
| DE | 19957518.00 | A1 | 9/2001 |
| DE | 19957518 | A1 | 9/2001 |
| EP | 116157.00 | A1 | 8/1984 |
| EP | 116157 | A1 | 8/1984 |
| EP | 167738.00 | A2 | 1/1986 |
| EP | 167738 | A2 | 1/1986 |
| EP | 0072104 | A1 | 2/1986 |
| EP | 0265276 | A2 | 4/1988 |
| EP | 0265276 | A2 | 6/1988 |
| EP | 0428424 | A2 | 5/1991 |
| EP | 1191268.00 | A1 | 3/2002 |
| EP | 1191268 | A1 | 3/2002 |
| EP | 1501159.00 | A1 | 1/2005 |
| EP | 1501159 | A1 | 1/2005 |
| EP | 1548898 | | 6/2005 |
| EP | 1548898.00 | A1 | 6/2005 |
| EP | 1701410.00 | A2 | 9/2006 |
| EP | 1701410 | A2 | 9/2006 |
| EP | 2242147 | A1 | 10/2010 |
| FR | 2232846.00 | A1 | 1/1975 |
| FR | 2232846 | A1 | 1/1975 |

(56) References Cited

FOREIGN PATENT DOCUMENTS

| | | | |
|---|---|---|---|
| FR | 2234680.00 | A2 | 1/1975 |
| FR | 2234680 | A2 | 1/1975 |
| FR | 2312918 | | 12/1976 |
| FR | 2312918.00 | | 12/1976 |
| FR | 2462798.00 | A1 | 2/1981 |
| FR | 2462798 | A1 | 2/1981 |
| FR | 2494508.00 | A1 | 5/1982 |
| FR | 2494508 | A1 | 5/1982 |
| GB | 589697.00 | A | 6/1947 |
| GB | 589697 | A | 6/1947 |
| GB | 1087228.00 | A | 10/1967 |
| GB | 1087228 | A | 10/1967 |
| GB | 1270846.00 | A | 4/1972 |
| GB | 1270846 | A | 4/1972 |
| GB | 1401373.00 | A | 7/1975 |
| GB | 1401373 | A | 7/1975 |
| GB | 2019665.00 | A | 10/1979 |
| GB | 2019665 | A | 10/1979 |
| GB | 2079549.00 | A | 1/1982 |
| GB | 2079549 | A | 1/1982 |
| GB | 2252677.00 | A | 8/1992 |
| GB | 2252677 | A | 8/1992 |
| GB | 2264201.00 | A | 8/1993 |
| GB | 2264201 | A | 8/1993 |
| GB | 2331634.00 | A | 5/1999 |
| GB | 2331634 | A | 5/1999 |
| GB | 2477479.00 | | 8/2010 |
| JP | 3074864.00 | | 1/2001 |
| JP | 2002-015823 | | 1/2002 |
| JP | 4503793.00 | B9 | 1/2002 |
| JP | 4503793 | B9 | 1/2002 |
| JP | 2002075556.00 | A | 3/2002 |
| JP | 2002075556 | A | 3/2002 |
| JP | 2001102299.00 | | 4/2002 |
| JP | 3280369.00 | B2 | 5/2002 |
| JP | 3280369 | B2 | 5/2002 |
| KR | 2006100622526.00 | B1 | 9/2006 |
| KR | 2006100622526 | B1 | 9/2006 |
| TW | 427044.00 | B | 3/2001 |
| TW | 427044 | B | 3/2001 |
| WO | 8700351 | | 1/1987 |
| WO | 0186756 | A1 | 11/2001 |
| WO | 02069457 | A1 | 9/2002 |
| WO | 2004013883 | A2 | 2/2004 |
| WO | 2006081141 | A1 | 8/2006 |
| WO | 2010135181 | | 11/2010 |
| WO | 2011128665 | A1 | 10/2011 |
| WO | 2011128666 | A1 | 10/2011 |
| WO | 2012061379 | A2 | 5/2012 |
| WO | 2012071379 | A2 | 5/2012 |

OTHER PUBLICATIONS

U.S. Appl. No. 13/726,347, filed Dec. 24, 2012.
U.S. Appl. No. 13/726,349, filed Dec. 24, 2012.
U.S. Appl. No. 13/726,339, filed Dec. 24, 2012.
U.S. Appl. No. 13/726,356, filed Dec. 24, 2012.
U.S. Appl. No. 13/726,330, filed Dec. 24, 2012.
ARRIS1; Digicon AVL Connector. ARRIS Group Inc. [online]. 3 pp.. [retrieved on Apr. 22, 2010]. Retrieved from the Internet<Url: http://www.arrisi.com/special/digiconAVL.asp>.
ISR1; PCT/US2011/057939 Date of Mailing: Apr. 30, 2012 International Search Report and Written Opinion. pp. 8.
LIT16; Report and Recommendation, Issued Dec. 5, 2013, John Mezzalingua Associates, Inc., d/b/a PPC, v. Corning Gilbert, Inc., United States District Court Northern District of New York, Civil Action No. 5:12-CV-00911-GLS-DEP, 52 pages.
NOA1; Notice of Allowance (Mail Date: Feb. 24, 2012) for U.S. Appl. No. 13/033,127 filed Feb. 23, 2011.
NOA2; Notice of Allowance (Mail Date: Jan. 24, 2013) for U.S. Appl. No. 13/072,350.
NOA3; Notice of Alowance (Date mailed: Jun. 25, 2012) for U.S. Appl. No. 12/633,792 filed Dec. 8, 2009.
NOA4; Notice of Allowance (Mail Date Mar. 20, 2012) for U.S. Appl. No. 13/117, 843 filed May 27, 2011; GAU 2839; Confirmation No. 8447.
OA1; Office Action mail date Mar. 29, 2013 for U.S. Appl. No. 13/712,470.
OA10; Final Office Action (Mail Date: Oct. 25, 2011) for U.S. Appl. No. 13/033,127 filed Feb. 23, 2011.
OA11; Office Action (Mail Date: Oct. 24, 2011) for U.S. Appl. No. 12/633,792 filed on Dec. 8, 2009.
OA2; Office Action (Mail Date Mar. 6, 2013) for U.S. Appl. No. 13/726,330 filed Dec. 24, 2012.
OA3; Office Action (Mail Date Feb. 20, 2013) for U.S. Appl. No. 13/726,349 filed Dec. 24, 2012.
OA4; Office Action (Mail Date Feb. 20, 2013) for U.S. Appl. No. 13/726,339 filed Dec. 24, 2012.
OA5; Office Action (Mail Date Mar. 11, 2013) for U.S. Appl. No. 13/726,347 filed Dec. 24, 2012.
OA6; Office Action (Mail Date Feb. 20, 2013) for U.S. Appl. No. 13/726,356 files Dec. 24, 2012.
OA7; Office Action (mail date Apr. 12, 2013) for U.S. Appl. No. 13/712,498 filed Dec. 12, 2012.
OA8; Office Action (mail date Jun. 11, 2013) for U.S. Appl. No. 13/860,964 filed Apr. 11, 2013.
OA9; Office Action (Mail Date: Jun. 2, 2011) for U.S. Appl. No. 13/033,127 filed Feb. 23, 2011.
RES1; Response dated Jun. 24, 2011 to Office Action (Mail Date: Jun. 2, 2011) for U.S. Appl. No. 13/033,127 filed Feb. 23, 2011.
TECHDOC1; Philips, NXP, "PDCCH message information content for persistent scheduling," R1-081506, Agenda Item: 6.1.3, 3GPP TSG RAN WG1 Meeting #52bis, Shenzhen, China, Mar. 31-Apr. 4, 2008, 3 pages.
TECHDOC10; PPC Product Guide, 2008.
TECHDOC2; NTT DoCoMo, Inc. "UL semi-persistent resource deactivation," R2-082483 (resubmission of R2-081859), Agenda Item: 5.1.1.8, 3GPP TSG RAN WG2 #62, Kansas City, MO, USA, May 5-9, 2008, 2 pages.
TECHDOC3; Panasonic, "Configuration for semi-persistent scheduling," R2-081575, Agenda Item: 5.1.1.8, 3GPP TSG RAN WG2 #61bis, Shenzhen, China, Mar. 31-Apr. 4, 2008, 4 pages.
TECHDOC4; Panasonic, "Remaining issues on Persistent scheduling," R2-083311, derived from R2082228 and R2-082229, Agenda Item: 6.1.1.8, 3GPP TSG RAN WG2 #62bis, Warsaw, Poland, Jun. 30-Jul. 4, 2008, 4 pages.
TECHDOC7; Nokia Corporation, Nokia Siemens Networks, "Persistent Scheduling for DL," R2-080683 (Rs-080018), 3GPP TSG-RAN WG2 Meeting #61, Agenda Item: 5.1.1.8, Sorrento, Italy, Feb. 11-15, 2008, 6 pages.
TECHDOC8; Panasonic, "SPS activation and release," R1-084233, 3GPP TSG-RAN WG1 Meeting #55, Prague, Czech Republic, Nov. 10-14, 2008, 6 pages.
TECHDOC9; PCT International, Inc., Compression Connectors Installation Guide, Aug. 3, 2009.
TechDoc11; NTT DoCoMo, Alcatel, Cingular Wireless, CMCC, Ericsson, Fujitsu, Huawei, LG Electronics, Lucent Technologies, Mitsubishi Electric, Motorola, NEC, Nokia, Nortel Networks, Orange, Panasonic, Philips, Qualcomm Europe, Samsung, Sharp Siemens, Telecom Italia, Telefonica, TeliaSonera, T-Mobile, Vodafone, "Proposed Study Item on Evolved UTRA and UTRAN," RP-040461, Agenda Item: 8.12, TSG-RAN Meeting #26, Athens, Greece, Dec. 8-10, 2004, 5 pages.
TECHSPEC1A; "3rd Generation Partnership Project; Technical Specification Group Radio Access Network; Requirements for Evolved UTRA (E-UTRA) and Evolved UTRAN (E-Utran) (Release 7)," Technical Report, 3GPP TR 125.913 V7.3.0, Mar. 2006, 18 pages.
TECHSPEC2A; "3rd Generation Partnership Project; Technical Specification Group Radio Access Network; Evolved Universal Terrestrial Radio Access (E-UTRA) and Evolved Universal Terrestrial Radio Access Network (E-UTRAN); Overall description; Stage 2 (Release 8)," Technical Specification, 3GPP TS 36.300 V8.5.0, May 2008, 134 pages.
TECHSPEC3A; "3rd Generation Partnership Project; Technical Specification Group Radio Access Network; Evolved Universal Ter-

(56) References Cited

OTHER PUBLICATIONS restrial Radio Access (E-UTRA) Medium Access Control (MAC) protocol specification (Release 8)," Technical Specification, 3GPP TS 36.321 V8.2.0, May 2008, 32 pages.
TECHSPEC4A; "3rd Generation Partnership Project; Technical Specification Group Radio Access Netowrk; Evolved Universal Terrestrial Radio Access (E-UTRA); Physical layer procedures (Release 8)," Technical Specification, 3GPP TS 36.213 V8.4.0, Sep. 2008, 60 pages.
TECHSPEC5A; Society of Cable Telecommunications Engineers, Engineering Committee, Interface Practices Subcommittee; American National Standard; ANSI/SCTE 01 2006; "Specification for "F" Port, Female, Outdoor". Published Jan. 2006. 9 pages.
TECHSPEC6A; Society of Cable Telecommunications Engineers, Engineering Committee, Interface Practices Subcommittee; American National Standard; ANSI/SCTE 02 2006; "Specification for "F" Port, Female, Indoor". Published Feb. 2006. 9 pages.
Patent Application No. GB1109575.9 Examination Report Under Section 18(3); Date of Report: Jun. 23, 2011. 3 pp.
Patent No. ZL2010202597847; Evaluation Report of Utility Model Patent; Date of Report: Sep. 2, 2011. 8 pages. (Chinese version with English Translation (10 pages) provided).
PCT/US2010/034870; International Filing Date May 14, 2010. International Search Report and Written Opinion. Date of Mailing: Nov. 30, 2010. 7 pages.
PPC Broadband, Inc., d/b/a PPC, v. PCT International, Inc., USDC, Northern District of New York, Case No. 5:13-cv-0135-GTS-DEP, Defendant PCT International, Inc.'s Disclosure of Preliminary Non-Infringement, Invalidity, and Unenforceability Contentions Filed Jul. 29, 2013. 86 pages.
PPC Broadband, Inc., d/b/a Ppc, v. PCT International, Inc., USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013. 14 pages.
PPC Broadband, Inc., d/b/a PPC, v. PCT International, Inc., USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013, Exhibits B1-B6. 68 pages.
PPC Broadband, Inc., d/b/a PPC, v. PCT International, Inc., USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013, Exhibits C1-C4. 122 pages.
PerfectVision Manufacturing, Inc. v. PPC Broadband, Inc., d/b/a PPC, USDC Eastern District of Arkansas Western Division, Case No. 4-12-CV-623-JLH, Plaintiff's Invalidity Contentions—Patent No. 8,366,481. 96 pages.
PerfectVision Manufacturing, Inc. v. PPC Broadband, Inc., d/b/a PPC, USDC Eastern District of Arkansas Western Division, Case No. 4-12-CV-623-JLH, Plaintiff's Invalidity Contentions—Patent No. 8,469,740. 78 pages.
PerfectVision Manufacturing, Inc. v. PPC Broadband, Inc., d/b/a PPC, USDC Eastern District of Arkansas Western Division, Case No. 4-12-CV-623-JLH, Plaintiff's Invalidity Contentions—Patent No. 8,475,205. 236 pages.
PerfectVision Manufacturing, Inc. v. PPC Broadband, Inc., d/b/a PPC, USDC Eastern District of Arkansas Western Division, Case No. 4-12-CV-623-JLH, Plaintiff's Invalidity Contentions—Patent No. 8,480,430. 189 pages.
PerfectVision Manufacturing, Inc. v. PPC Broadband, Inc., d/b/a PPC, USDC Eastern District of Arkansas Western Division, Case No. 4-12-CV-623-JLH, Plaintiff's Invalidity Contentions—Patent No. 8,480,431. 73 pages.
PerfectVision Manufacturing, Inc. v. PPC Broadband, Inc., d/b/a PPC, USDC Eastern District of Arkansas Western Division, Case No. 4-12-CV-623-JLH, Plaintiff's Invalidity Contentions—Patent No. 8,485,845. 73 pages.
Office Action (Mail Date Feb. 20, 2013) for U.S. Appl. No. 13/726,349 filed Dec. 24, 2012.
Office Action (Mail Date Feb. 20, 2013) for U.S. Appl. No. 13/726,339 filed Dec. 24, 2012.
Office Action (Mail Date Feb. 20, 2013) for U.S. Appl. No. 13/726,356 filed Dec. 24, 2012.
Office Action (Mail Date Mar. 11, 2013) for U.S. Appl. No. 13/726,347 filed Dec. 24, 2012.
Office Action (Mail Date Mar. 6, 2013) for U.S. Appl. No. 13/726,330 filed Dec. 24, 2012.
U.S. Reexamination Control U.S. Appl. No. 90/012,749 of U. S. Patent No. 7,114,990 filed Dec. 21, 2012.
State Intellectual Property Office, P.R. China, Office Action dated Dec. 2, 2013 from Chinese Patent Application No. 201010229211.4 filed May 21, 2010, total 22 pages.
LIT13; PPC Broadband, Inc., d/b/a PPC, v. PCT International, Inc., USDC, Northern District of New York, Case No. 5:13-cv-0135-GTS-DEP, Defendant PCT International, Inc.'s Disclosure of Preliminary Non-Infringement, Invalidity, and Unenforceability Contentions Filed Jul. 29, 2013. 86 pages.
LIT14; PPC Broadband, Inc., d/b/a PPC, v. PCT International, Inc., USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013. 14 pages.
LIT14B; PPC Broadband, Inc., d/b/a PPC, v. PCT International, Inc., USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013, Exhibits B1-B6. 68 pages.
LIT14C; PPC Broadband, Inc., d/b/a PPC, v. PCT International, Inc., USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013, Exhibits C1-C4. 122 pages.
LIT15; PerfectVision Manufacturing, Inc. v. PPC Broadband, Inc., d/b/a PPC, USDC Eastern District of Arkansas Western Division, Case No. 4-12-CV-623-JLH, Plaintiff's Invalidity Contentions—Patent No. 8,366,481. 96 pages.
LIT15B; PerfectVision Manufacturing, Inc. v. PPC Broadband, Inc., d/b/a PPC, USDC Eastern District of Arkansas Western Division, Case No. 4-12-CV-623-JLH, Plaintiff's Invalidity Contentions—Patent No. 8,469,740. 78 pages.
LIT15C; PerfectVision Manufacturing, Inc. v. PPC Broadband, Inc., d/b/a PPC, USDC Eastern District of Arkansas Western Division, Case No. 4-12-CV-623-JLH, Plaintiff's Invalidity Contentions—Patent No. 8,475,205. 236 pages.
LIT15D; PerfectVision Manufacturing, Inc. v. PPC Broadband, Inc., d/b/a PPC, USDC Eastern District of Arkansas Western Division, Case No. 4-12-CV-623-JLH, Plaintiff's Invalidity Contentions—Patent No. 8,480,430. 189 pages.
LIT15E;PerfectVision Manufacturing, Inc. v. PPC Broadband, Inc., d/b/a PPC, USDC Eastern District of Arkansas Western Division, Case No. 4-12-CV-623-JLH, Plaintiff's Invalidity Contentions—Patent No. 8,480,431. 73 pages.
LIT15F; PerfectVision Manufacturing, Inc. v. PPC Broadband, Inc., d/b/a PPC, USDC Eastern District of Arkansas Western Division, Case No. 4-12-CV-623-JLH, Plaintiff's Invalidity Contentions—Patent No. 8,485,845. 73 pages.
EESR1; Extended European Search Report; European Application No. 12763440.0; Date of Mailing: Jul. 22, 2014; 9 pages.

CONTINUITY MAINTAINING BIASING MEMBER

CROSS-REFERENCE TO RELATED APPLICATIONS

This application claims priority to and is a continuation-in-part of U.S. application Ser. No. 13/075,406, filed on Mar. 30, 2011, and entitled "CONTINUITY MAINTAINING BIASING MEMBER."

FIELD OF TECHNOLOGY

The following relates to connectors used in coaxial cable communication applications, and more specifically to embodiments of a connector having a biasing member for maintaining continuity through a connector.

BACKGROUND

Connectors for coaxial cables are typically connected onto complementary interface ports to electrically integrate coaxial cables to various electronic devices. Maintaining continuity through a coaxial cable connector typically involves the continuous contact of conductive connector components which can prevent radio frequency (RF) leakage and ensure a stable ground connection. In some instances, the coaxial cable connectors are present outdoors, exposed to weather and other numerous environmental elements. Weathering and various environmental elements can work to create interference problems when metallic conductive connector components corrode, rust, deteriorate or become galvanically incompatible, thereby resulting in intermittent contact, poor electromagnetic shielding, and degradation of the signal quality. Moreover, some metallic connector components can permanently deform under the torque requirements of the connector mating with an interface port. The permanent deformation of a metallic connector component results in intermittent contact between the conductive components of the connector and a loss of continuity through the connector.

Thus, a need exists for an apparatus and method for ensuring continuous contact between conductive components of a connector.

SUMMARY

A first general aspect relates to a coaxial cable connector comprising a post having a first end, a second end, and a flange proximate the second end, wherein the post is configured to receive a center conductor surrounded by a dielectric of a coaxial cable, a connector body attached to the post, a coupling element attached to the post, the coupling element having a first end and a second end, and a biasing member disposed within a cavity formed between the first end of the coupling element and the connector body to bias the coupling element against the post.

A second aspect relates generally to a coaxial cable connector comprising a post having a first end, a second end, and a flange proximate the second end, wherein the post is configured to receive a center conductor surrounded by a dielectric of a coaxial cable, a coupling element attached to the post, the coupling element having a first end and a second end, and a connector body having a biasing member, wherein the biasing member biases the coupling element against the post.

A third aspect relates generally to a coaxial cable connector comprising a post having a first end, a second end, and a flange proximate the second end, wherein the post is configured to receive a center conductor surrounded by a dielectric of a coaxial cable, a connector body attached to the post, a coupling element attached to the post, the coupling element having a first end and a second end, and a means for biasing the coupling element against the post, wherein the means does not hinder rotational movement of the coupling element.

A fourth aspect relates generally to a method of facilitating continuity through a coaxial cable connector, comprising providing a post having a first end, a second end, and a flange proximate the second end, wherein the post is configured to receive a center conductor surrounded by a dielectric of a coaxial cable, a connector body attached to the post, and a coupling element attached to the post, the coupling element having a first end and a second end, and disposing a biasing member within a cavity formed between the first end of the coupling element and the connector body to bias the coupling element against the post.

A fifth aspect relates generally to a method of facilitating continuity through a coaxial cable connector, comprising providing a post having a first end, a second end, and a flange proximate the second end, wherein the post is configured to receive a center conductor surrounded by a dielectric of a coaxial cable, a coupling element attached to the post, the coupling element having a first end and a second end, and a connector body having a first end, a second end, and an annular recess proximate the second end of the connector body, extending the annular recess a radial distance to engage the coupling element, wherein the engagement between the extended annular recess and the coupling element biases the coupling element against the post.

A sixth aspect relates generally to a coaxial cable connector comprising a post having a first end, a second end, and a flange, wherein the post is configured to receive a center conductor surrounded by a dielectric of a coaxial cable, a coupling element configured to engage the post and configured to move between a first position, where, as the coupling element is tightened onto an interface port, the post does not contact the interface port, and a second position, where, as the coupling element is tightened onto the interface port, the post contacts the interface portion, the second position being axially spaced from the first position, the coupling element having a first end, a second end and an inward lip, and a connector body configured to engage the post and receive the coaxial cable, when the connector is in an assembled state, the connector body including: an integral body biasing element having a coupling element contact portion extending from the body and configured to contact the body when the connector is in the assembled state; and an annular groove configured to allow the integral body biasing element to deflect along the axial direction; wherein the integral body biasing element is configured to exert a biasing force against the coupling element sufficient to axially urge the inward lip of the coupling element away from the connector body and toward the flange of the post at least until the post contacts the interface port as the coupling element is tightened on the interface port, so as to improve electrical grounding reliability between the coupling element and the post, even when the post is not in contact with the interface port.

A seventh aspect relates generally to a method of improving electrical continuity through a coaxial cable connector, comprising: providing a post having a first end, a second end, and a flange, wherein the post is configured to receive a center conductor surrounded by a dielectric of a coaxial cable, operably attaching a coupling element to the post, the coupling element having a first end, a second end, and an inward lip having a contact surface extending along a radial direction and facing away from the flange of the post when the connector is in an assembled state, providing a connector body having a first end, a second end, and an integral resilient biasing member having a contact portion extending from the connector body and toward the inward lip of the coupling element when the connector is in the assembled state, the integral resilient biasing member of the connector body being operable with an annular groove of the connector body to allow the integral resilient biasing member to deflect along the axial direction; and positioning the integral resilient biasing member of the connector body so that the integral resilient biasing member contacts the coupling element and exerts a biasing force on the coupling element in a direction toward the flange of the post urging the coupling element toward the flange of the post, when the connector is in the assembled state; wherein the urging of the coupling element toward the flange of the post as the integral resilient biasing member exerts a biasing force against the coupling element improves electrical contact between the coupling element and the post.

An eighth aspect relates generally to a connector for coupling an end of a coaxial cable, the coaxial cable having a center conductor surrounded by a dielectric, the dielectric being surrounded by a conductive grounding shield, the conductive grounding shield being surrounded by a protective outer jacket, the connector comprising: a post including a forward post end, a rearward post end, and a flange having a forward facing flange surface, a rearward facing flange surface, a lip surface extending from the rearward facing flange surface, and a continuity post engaging surface extending from the lip surface, wherein the rearward post end is configured to be inserted into an end of the coaxial cable around the dielectric and under at least a portion of the conductive grounding shield thereof to make electrical contact with the conductive grounding shield of the coaxial cable, a connector body having a forward body end and a rearward body end, a coupler configured to rotate relative to the post and the connector body, the coupler including a forward coupler end configured for fastening to an interface port and to move between a partially tightened coupler position on the interface port and a fully tightened coupler position on the interface port, a rearward coupler end, and an internal lip having a forward facing lip surface facing the forward coupler end and configured to rotate relative to the rearward facing flange surface of the post and allow the post to pivot relative to the coupler, and a rearward facing lip surface facing the rearward coupler end, and a biasing member disposed only rearward of the forward facing lip surface of the internal lip of the coupler, the biasing member being one or more resilient fingers arcuately extending from the forward end of the connector body, the one or more resilient fingers separated by one or openings, the one or more resilient fingers extending a radial distance with respect to a central axis of the connector to facilitate biasing engagement with the rearward facing lip surface of the coupler so as to maintain electrical continuity between the coupler and the post when the coupler is in the partially tightened coupler position on the interface port, when the coupler is in the fully tightened coupler position on the interface port, and when the post moves relative to the coupler.

A ninth aspect relates generally to a connector for coupling an end of a coaxial cable, the coaxial cable having a center conductor surrounded by a dielectric, the dielectric being surrounded by a conductive grounding shield, the conductive grounding shield being surrounded by a protective outer jacket, the connector comprising: a post including a forward post end, a rearward post end, and a flange having a forward facing flange surface, a rearward facing flange surface, a lip surface extending from the rearward facing flange surface, and a continuity post engaging surface extending from the lip surface, wherein the rearward post end is configured to be inserted into an end of the coaxial cable around the dielectric and under at least a portion of the conductive grounding shield thereof to make electrical contact with the conductive grounding shield of the coaxial cable, a connector body having a forward body end and a rearward body end, a coupler configured to rotate relative to the post and the connector body, the coupler including a forward coupler end configured for fastening to an interface port and to move between a partially tightened coupler position on the interface port and a fully tightened coupler position on the interface port, a rearward coupler end, and an internal lip having a forward facing lip surface facing the forward coupler end and configured to rotate relative to the rearward facing flange surface of the post and allow the post to pivot relative to the coupler, and a rearward facing lip surface facing the rearward coupler end, and a biasing member disposed only rearward of the rearward facing lip surface of the internal lip of the coupler, the biasing member being one or more resilient fingers arcuately extending radially and axially from the connector body, the biasing member including a notch to permit a deflection of the biasing member to provide a biasing force to effectuate constant physical contact between the forward facing lip surface of the coupler and the post, wherein the notch is an annular void located axially rearward of the one or more resilient fingers of the biasing member that permits the deflection of the one or more resilient fingers in an axial direction with respect to a general axis of the connector when the coupler is in the partially tightened coupler position on the interface port, when the coupler is in the fully tightened coupler position on the interface port, and when the post moves relative to the coupler.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1A:
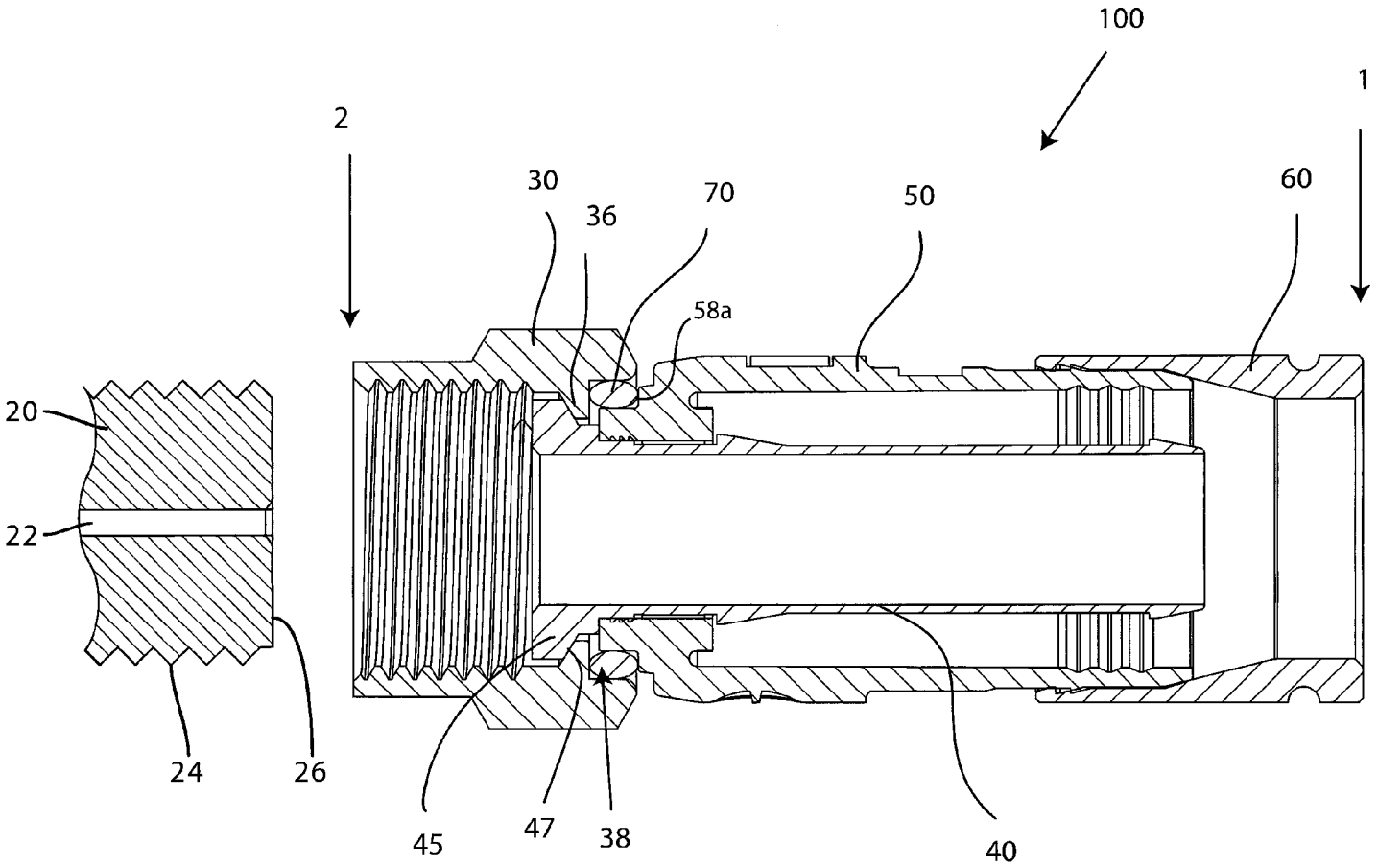
FIG. 1A depicts a cross-sectional view of a first embodiment of a coaxial cable connector.
Figure 1B:
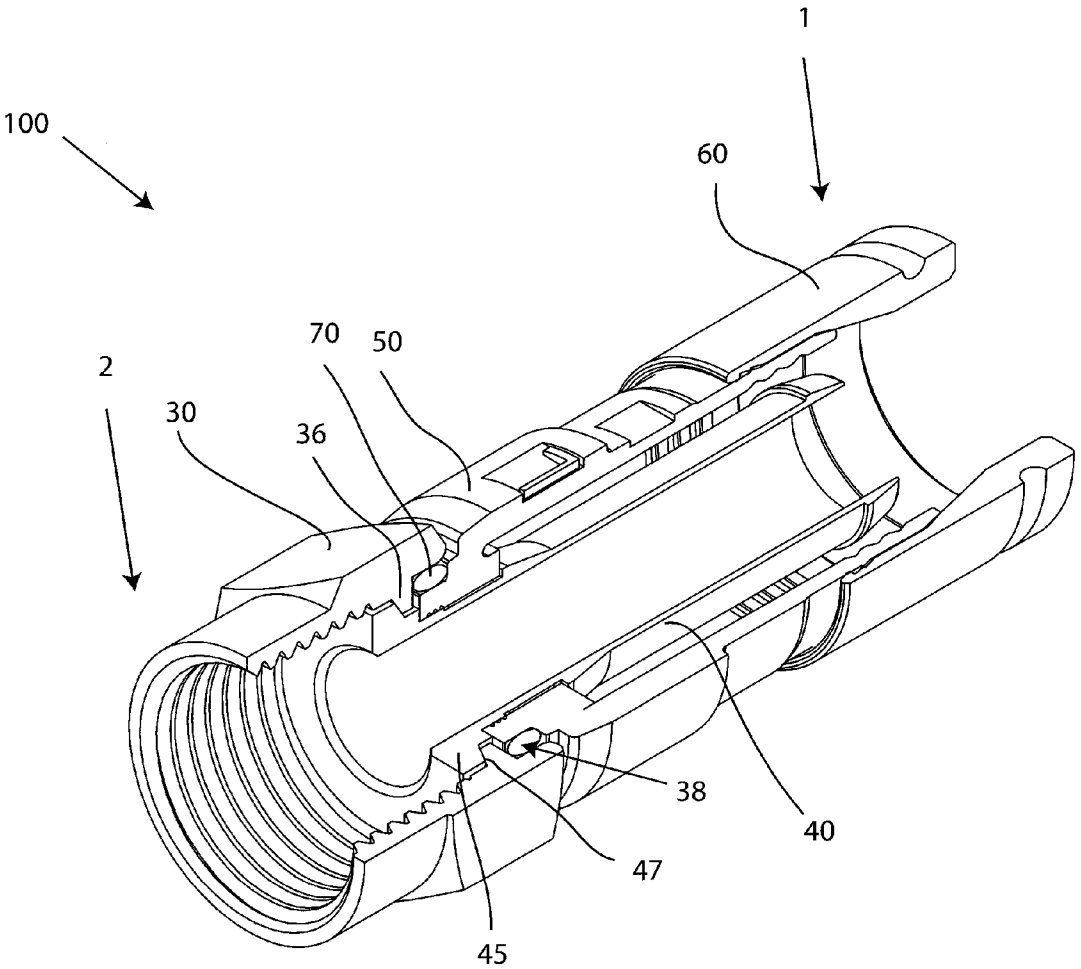
FIG. 1B depicts a perspective cut-away view of the first embodiment of a coaxial cable connector.

Referring to the drawings, FIG. 1 depicts an embodiment of a coaxial cable connector 100. A coaxial cable connector embodiment 100 has a first end 1 and a second end 2, and can be provided to a user in a preassembled configuration to ease handling and installation during use. Coaxial cable connector 100 may be an F connector, or similar coaxial cable connector. Furthermore, the connector 100 includes a post 40 configured for receiving a prepared portion of a coaxial cable 10.

Figure 2:
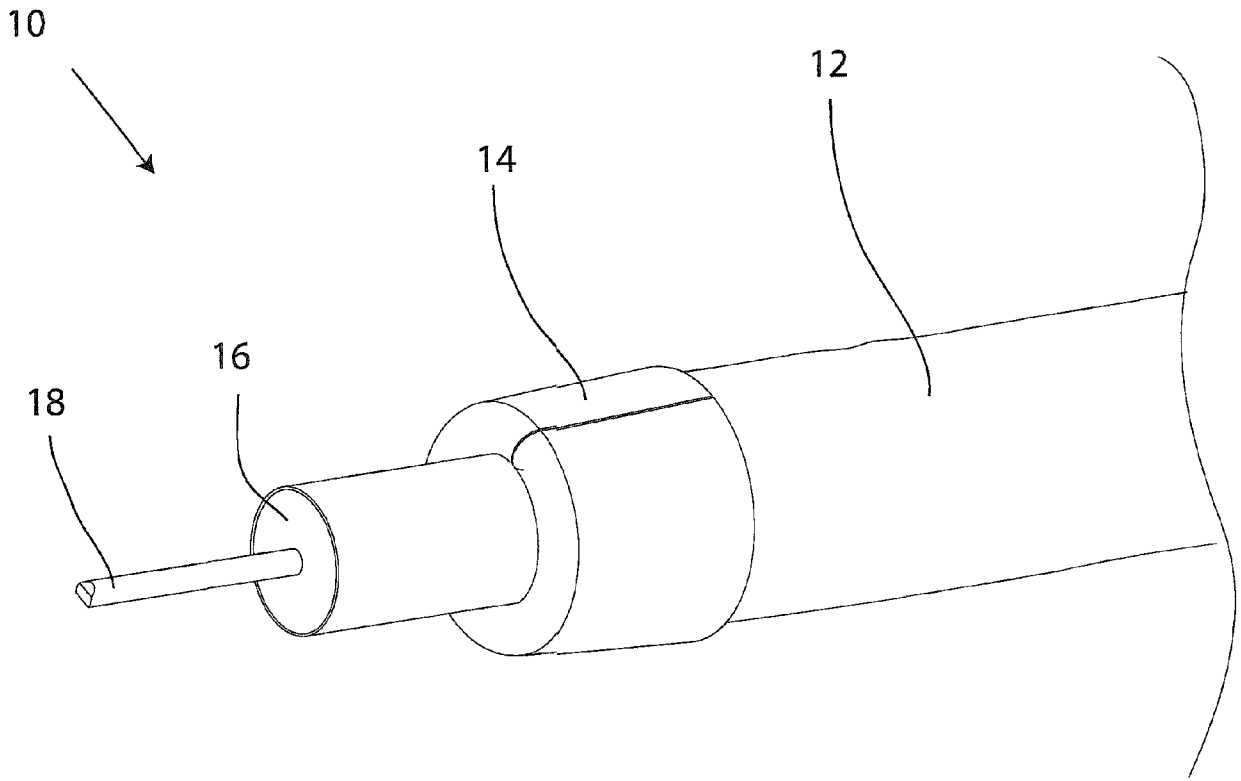
FIG. 2 depicts a perspective view of an embodiment of a coaxial cable.

Referring now to FIG. 2, the coaxial cable connector 100 may be operably affixed to a prepared end of a coaxial cable 10 so that the cable 10 is securely attached to the connector 100. The coaxial cable 10 may include a center conductive strand 18, surrounded by an interior dielectric 16; the interior dielectric 16 may possibly be surrounded by a conductive foil layer; the interior dielectric 16 (and the possible conductive foil layer) is surrounded by a conductive strand layer 14; the conductive strand layer 14 is surrounded by a protective outer jacket 12*a*, wherein the protective outer jacket 12 has dielectric properties and serves as an insulator. The conductive strand layer 14 may extend a grounding path providing an electromagnetic shield about the center conductive strand 18 of the coaxial cable 10. The coaxial cable 10 may be prepared by removing the protective outer jacket 12 and drawing back the conductive strand layer 14 to expose a portion of the interior dielectric 16 (and possibly the conductive foil layer that may tightly surround the interior dielectric 16) and center conductive strand 18. The protective outer jacket 12 can physically protect the various components of the coaxial cable 10 from damage which may result from exposure to dirt or moisture, and from corrosion. Moreover, the protective outer jacket 12 may serve in some measure to secure the various components of the coaxial cable 10 in a contained cable design that protects the cable 10 from damage related to movement during cable installation. However, when the protective outer jacket 12 is exposed to the environment, rain and other environmental pollutants may travel down the protective outer jack 12. The conductive strand layer 14 can be comprised of conductive materials suitable for carrying electromagnetic signals and/or providing an electrical ground connection or electrical path connection. The conductive strand layer 14 may also be a conductive layer, braided layer, and the like. Various embodiments of the conductive strand layer 14 may be employed to screen unwanted noise. For instance, the conductive strand layer 14 may comprise a metal foil (in addition to the possible conductive foil) wrapped around the dielectric 16 and/or several conductive strands formed in a continuous braid around the dielectric 16. Combinations of foil and/or braided strands may be utilized wherein the conductive strand layer 14 may comprise a foil layer, then a braided layer, and then a foil layer. Those in the art will appreciate that various layer combinations may be implemented in order for the conductive strand layer 14 to effectuate an electromagnetic buffer helping to preventingress of environmental noise or unwanted noise that may disrupt broadband communications. In some embodiments, there may be flooding compounds protecting the conductive strand layer 14. The dielectric 16 may be comprised of materials suitable for electrical insulation. The protective outer jacket 12 may also be comprised of materials suitable for electrical insulation. It should be noted that the various materials of which all the various components of the coaxial cable 10 can have some degree of elasticity allowing the cable 10 to flex or bend in accordance with traditional broadband communications standards, installation methods and/or equipment. It can further be recognized that the radial thickness of the coaxial cable 10, protective outer jacket 12, conductive strand layer 14, possible conductive foil layer, interior dielectric 16 and/or center conductive strand 18 may vary based upon generally recognized parameters corresponding to broadband communication standards and/or equipment.

Furthermore, environmental elements that contact conductive components, including metallic components, of a coaxial connector may be important to the longevity and efficiency of the coaxial cable connector (i.e. preventing RF leakage and ensuring stable continuity through the connector 100). Environmental elements may include any environmental pollutant, any contaminant, chemical compound, rainwater, moisture, condensation, stormwater, polychlorinated biphenyl's (PCBs), contaminated soil from runoff, pesticides, herbicides, and the like. Environmental elements, such as water or moisture, may corrode, rust, degrade, etc. connector components exposed to the environmental elements. Thus, metallic conductive O-rings utilized by a coaxial cable connector that may be disposed in a position of exposure to environmental elements may be insufficient over time due to the corrosion, rusting, and overall degradation of the metallic O-ring.

Referring back to FIG. 1, the connector 100 may mate with a coaxial cable interface port 20. The coaxial cable interface port 20 includes a conductive receptacle 22 for receiving a portion of a coaxial cable center conductor 18 sufficient to make adequate electrical contact. The coaxial cable interface port 20 may further comprise a threaded exterior surface 24. However, various embodiments may employ a smooth surface, as opposed to threaded exterior surface. In addition, the coaxial cable interface port 20 may comprise a mating edge 26. It can be recognized that the radial thickness and/or the length of the coaxial cable interface port 20 and/or the conductive receptacle 22 may vary based upon generally recognized parameters corresponding to broadband communication standards and/or equipment. Moreover, the pitch and depth of threads which may be formed upon the threaded exterior surface 24 of the coaxial cable interface port 20 may also vary based upon generally recognized parameters corresponding to broadband communication standards and/or equipment. Furthermore, it can be noted that the interface port 20 may be formed of a single conductive material, multiple conductive materials, or may be configured with both conductive and non-conductive materials corresponding to the port's 20 electrical interface with a coaxial cable connector, such as connector 100. For example, the threaded exterior surface may be fabricated from a conductive material, while the material comprising the mating edge 26 may be non-conductive or vice versa. However, the conductive receptacle 22 can be formed of a conductive material. Further still, it will be understood by those of ordinary skill that the interface port 20 may be embodied by a connective interface component of a communications modifying device such as a signal splitter, a cable line extender, a cable network module and/or the like.

Referring further to FIG. 1, embodiments of a connector 100 may include a post 40, a coupling element 30, a connector body 50, a fastener member 60, and a biasing member 70. Embodiments of connector 100 may also include a post 40 having a first end 41, a second end 42, and a flange 45 proximate the second end 42, wherein the post 40 is configured to receive a center conductor 18 surrounded by a dielectric 16 of a coaxial cable 10, a connector body 50 attached to the post 40, a coupling element 30 attached to the post 40, the coupling element 30 having a first end 31 and a second end 32, and a biasing member 70 disposed within a cavity 38 formed between the first end 31 of the coupling element 30 and the connector body 50 to bias the coupling element 30 against the post 40.

Figure 3:
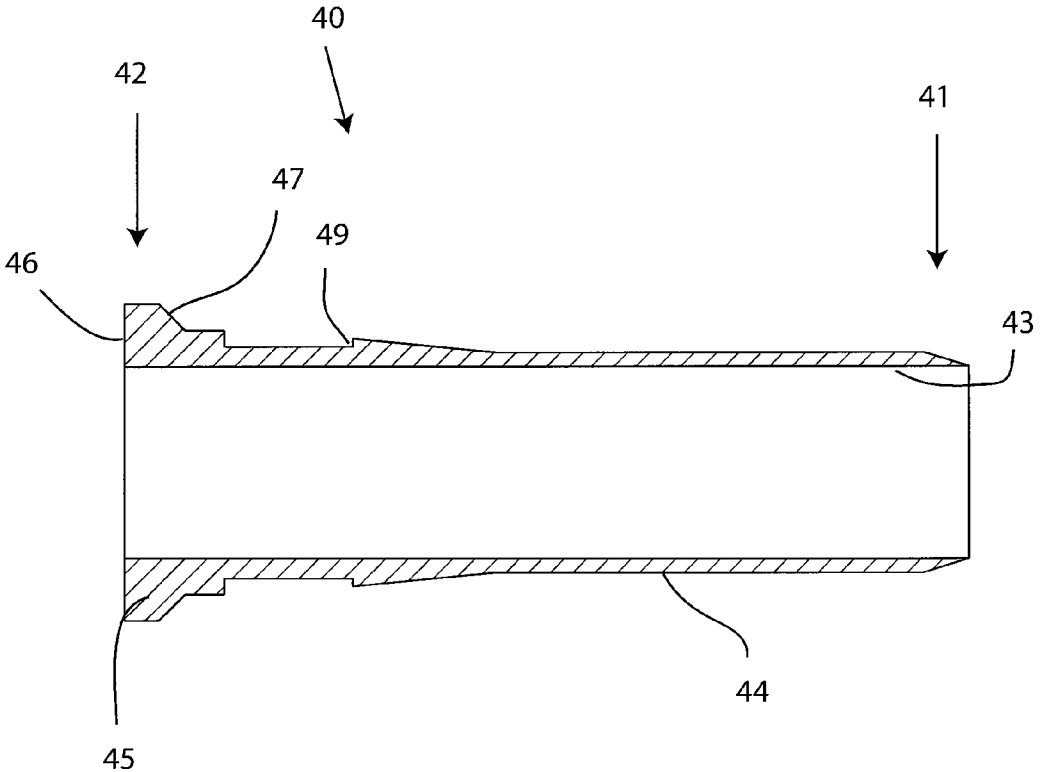
FIG. 3 depicts a cross-sectional view of an embodiment of a post.

Embodiments of connector 100 may include a post 40, as further shown in FIG. 3. The post 40 comprises a first end 41, a second end 42, an inner surface 43, and an outer surface 44. Furthermore, the post 40 may include a flange 45, such as an externally extending annular protrusion, located proximate or otherwise near the second end 42 of the post 40. The flange 45 may include an outer tapered surface 47 facing the first end 41 of the post 40 (i.e. tapers inward toward the first end 41 from a larger outer diameter proximate or otherwise near the second end 42 to a smaller outer diameter. The outer tapered surface 47 of the flange 45 may correspond to a tapered surface of the lip 36 of the coupling element 30. Further still, an embodiment of the post 40 may include a surface feature 49 such as a lip or protrusion that may engage a portion of a connector body 50 to secure axial movement of the post 40 relative to the connector body 50. However, the post may not include such a surface feature 49, and the coaxial cable connector 100 may rely on press-fitting and friction-fitting forces and/or other component structures to help retain the post 40 in secure location both axially and rotationally relative to the connector body 50. The location proximate or otherwise near where the connector body 50 is secured relative to the post 40 may include surface features, such as ridges, grooves, protrusions, or knurling, which may enhance the secure location of the post 40 with respect to the connector body 50. Additionally, the post 40 includes a mating edge 46, which may be configured to make physical and electrical contact with a corresponding mating edge 26 of an interface port 20. The post 40 can be formed such that portions of a prepared coaxial cable 10 including the dielectric 16 and center conductor 18 can pass axially into the first end 41 and/or through a portion of the tube-like body of the post 40. Moreover, the post 40 can be dimensioned such that the post 40 may be inserted into an end of the prepared coaxial cable 10, around the dielectric 16 and under the protective outer jacket 12 and conductive grounding shield or strand 14. Accordingly, where an embodiment of the post 40 may be inserted into an end of the prepared coaxial cable 10 under the drawn back conductive strand 14, substantial physical and/or electrical contact with the strand layer 14 may be accomplished thereby facilitating grounding through the post 40. The post 40 may be formed of metals or other conductive materials that would facilitate a rigidly formed post body. In addition, the post 40 may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, or other fabrication methods that may provide efficient production of the component.

Figure 4:
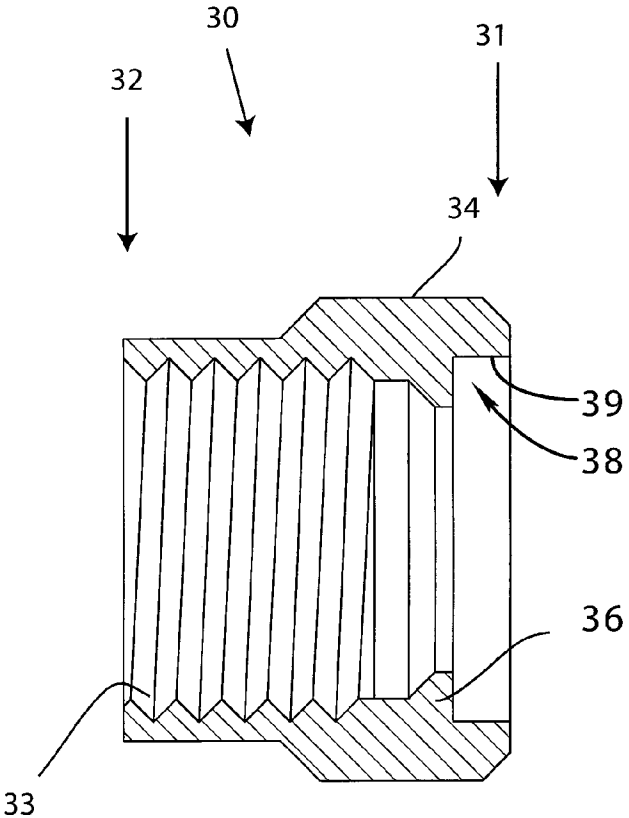
FIG. 4 depicts a cross-sectional view of an embodiment of a coupling element.

With continued reference to FIG. 1, and further reference to FIG. 4, embodiments of connector 100 may include a coupling element 30. The coupling element 30 may be a nut, a threaded nut, port coupling element, rotatable port coupling element, and the like. The coupling element 30 may include a first end 31, second end 32, an inner surface 33, and an outer surface 34. The inner surface 33 of the coupling element 30 may be a threaded configuration, the threads having a pitch and depth corresponding to a threaded port, such as interface port 20. In other embodiments, the inner surface 33 of the coupling element 30 may not include threads, and may be axially inserted over an interface port, such as port 20. The coupling element 30 may be rotatably secured to the post 40 to allow for rotational movement about the post 40. The coupling element 30 may comprise an internal lip 36 located proximate the first end 31 and configured to hinder axial movement of the post 40. Furthermore, the coupling element 30 may comprise a cavity 38 extending axially from the edge of first end 31 and partial defined and bounded by the internal lip 36. The cavity 38 may also be partially defined and bounded by an outer internal wall 39. The coupling element 30 may be formed of conductive materials facilitating grounding through the coupling element 30, or threaded nut. Accordingly the coupling element 30 may be configured to extend an electromagnetic buffer by electrically contacting conductive surfaces of an interface port 20 when a coaxial cable connector, such as connector 100, is advanced onto the port 20. In addition, the coupling element 30 may be formed of non-conductive material and function only to physically secure and advance a connector 100 onto an interface port 20. Moreover, the coupling element 30 may be formed of both conductive and non-conductive materials. For example the internal lip 36 may be formed of a polymer, while the remainder of the coupling element 30 may be comprised of a metal or other conductive material. In addition, the coupling element 30 may be formed of metals or polymers or other materials that would facilitate a rigidly formed body. Manufacture of the coupling element 30 may include casting, extruding, cutting, turning, tapping, drilling, injection molding, blow molding, or other fabrication methods that may provide efficient production of the component. Those in the art should appreciate the various of embodiments of the nut 30 may also comprise a coupler member, or coupling element, having no threads, but being dimensioned for operable connection to a corresponding interface port, such as interface port 20.

Figure 5:
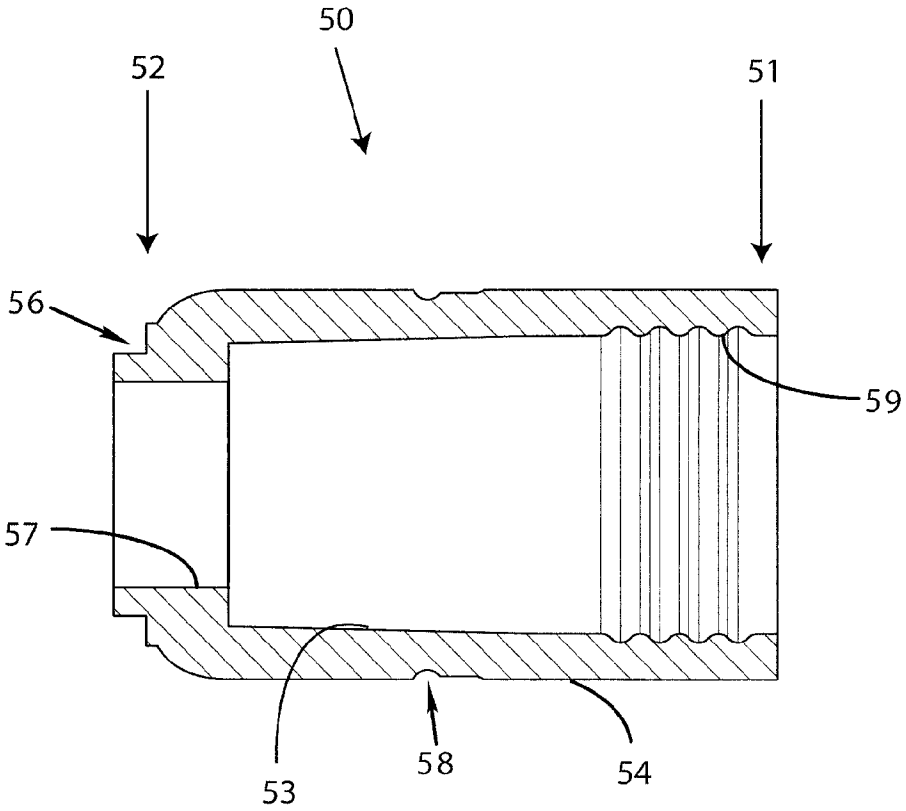
FIG. 5 depicts a cross-sectional view of a first embodiment of a connector body.

Referring still to FIG. 1, and additionally to FIG. 5, embodiments of a coaxial cable connector, such as connector 100, may include a connector body 50. The connector body 50 may include a first end 51, a second end 52, an inner surface 53, and an outer surface 54. Moreover, the connector body may include a post mounting portion 57 proximate or otherwise near the second end 52 of the body 50; the post mounting portion 57 configured to securely locate the body 50 relative to a portion of the outer surface 44 of post 40, so that the connector body 50 is axially secured with respect to the post 40, in a manner that prevents the two components from moving with respect to each other in a direction parallel to the axis of the connector 100. In addition, the connector body 50 may include an outer annular recess 56 located proximate or near the second end 52 of the connector body 50. Furthermore, the connector body 50 may include a semi-rigid, yet compliant outer surface 54, wherein the outer surface 54 may be configured to form an annular seal when the first end 51 is deformably compressed against a received coaxial cable 10 by operation of a fastener member 60. The connector body 50 may include an external annular detent 58 located along the outer surface 54 of the connector body 50. Further still, the connector body 50 may include internal surface features 59, such as annular serrations formed near or proximate the internal surface of the first end 51 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 54. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

Figure 6:
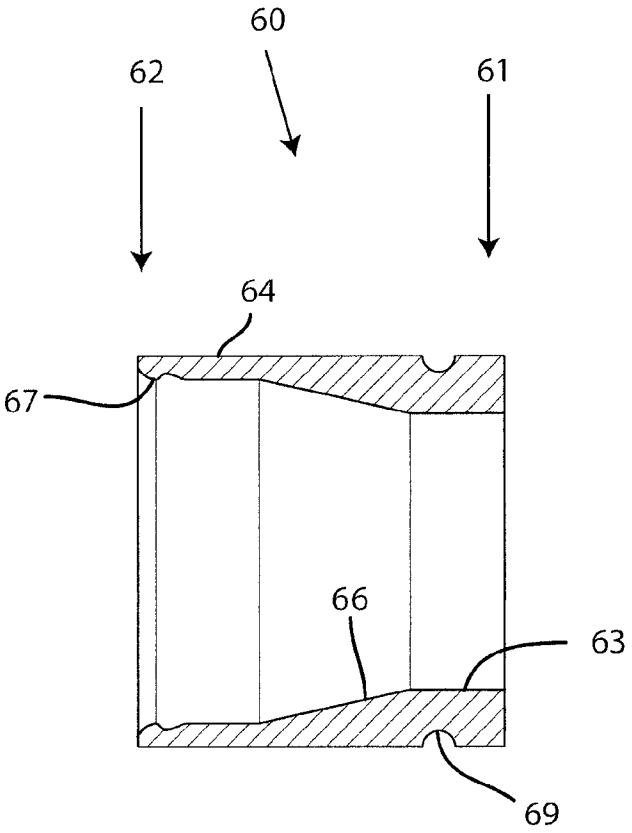
FIG. 6 depicts a cross-sectional view of an embodiment of a fastener member.

With further reference to FIG. 1 and FIG. 6, embodiments of a coaxial cable connector 100 may include a fastener member 60. The fastener member 60 may have a first end 61, second end 62, inner surface 63, and outer surface 64. In addition, the fastener member 60 may include an internal annular protrusion 67 located proximate the second end 62 of the fastener member 60 and configured to mate and achieve purchase with the annular detent 58 on the outer surface 54 of connector body 50. Moreover, the fastener member 60 may comprise a central passageway or generally axial opening defined between the first end 61 and second end 62 and extending axially through the fastener member 60. The central passageway may include a ramped surface 66 which may be positioned between a first opening or inner bore having a first inner diameter positioned proximate or otherwise near the first end 61 of the fastener member 60 and a second opening or inner bore having a larger, second inner diameter positioned proximate or otherwise near the second end 62 of the fastener member 60. The ramped surface 66 may act to deformably compress the outer surface 54 of the connector body 50 when the fastener member 60 is operated to secure a coaxial cable 10. For example, the narrowing geometry will compress squeeze against the cable, when the fastener member 60 is compressed into a tight and secured position on the connector body 50. Additionally, the fastener member 60 may comprise an exterior surface feature 69 positioned proximate with or close to the first end 61 of the fastener member 60. The surface feature 69 may facilitate gripping of the fastener member 60 during operation of the connector 100. Although the surface feature 69 is shown as an annular detent, it may have various shapes and sizes such as a ridge, notch, protrusion, knurling, or other friction or gripping type arrangements. The second end 62 of the fastener member 60 may extend an axial distance so that, when the fastener member 60 is compressed into sealing position on the coaxial cable 100, the fastener member 60 touches or resides substantially proximate significantly close to the coupling element 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

Referring back to FIG. 1, embodiments of a coaxial cable connector 100 can include a biasing member 70. The biasing member 70 may be formed of a non-metallic material to avoid rust, corrosion, deterioration, and the like, caused by environmental elements, such as water. Additional materials the biasing member 70 may be formed of may include, but are not limited to, polymers, plastics, elastomers, elastomeric mixtures, composite materials, rubber, and/or the like and/or any operable combination thereof. The biasing member 70 may be a resilient, rigid, semi-rigid, flexible, or elastic member, component, element, and the like. The resilient nature of the biasing member 70 may help avoid permanent deformation while under the torque requirements when a connector 100 is advanced onto an interface port 20.

Moreover, the biasing member 70 may facilitate constant contact between the coupling element 30 and the post 40. For instance, the biasing member 70 may bias, provide, force, ensure, deliver, etc. the contact between the coupling element 30 and the post 40. The constant contact between the coupling element 30 and the post 40 promotes continuity through the connector 100, reduces/eliminates RF leakage, and ensures a stable ground through the connection of a connector 100 to an interface port 20 in the event the connector 100 is not fully tightened onto the port 20. To establish and maintain solid, constant contact between the coupling element 30 and the post 40, the biasing member 70 may be disposed behind the coupling element 30, proximate or otherwise near the second end 52 of the connector. In other words, the biasing member 70 may be disposed within the cavity 38 formed between the coupling element 30 and a shoulder surface 58*a* forming part of the annular recess 56 of the connector body 50. The biasing member 70 can provide a biasing force against the coupling element 30, which may axially displace the coupling element 30 into constant direct contact with the post 40. In particular, the disposition of a biasing member 70 in annular cavity 38 proximate the second end 52 of the connector body 50 may axially displace the coupling element 30 towards the post 40, wherein the lip 36 of the coupling element 30 directly contacts the outer tapered surface 47 of the flange 45 of the post 40. The location and structure of the biasing member 70 may promote continuity between the post 40 and the coupling element 30, but may not impede the rotational movement of the coupling element 30 (e.g. rotational movement about the post 40). The biasing member 70 may also create a barrier against environmental elements, thereby preventing environmental elements from entering the connector 100. Those skilled in the art would appreciate that the biasing member 70 may be fabricated by extruding, coating, molding, injecting, cutting, turning, elastomeric batch processing, vulcanizing, mixing, stamping, casting, and/or the like and/or any combination thereof in order to provide efficient production of the component.

Embodiments of biasing member 70 may include an annular or semi-annular resilient member or component configured to physically and electrically couple the post 40 and the coupling element 30. One embodiment of the biasing member 70 may be a substantially circinate torus or toroid structure, or other ring-like structure having a diameter (or cross-section area) large enough that when disposed within annular cavity 38 proximate the annular recess 56 of the connector body 50, the coupling element 30 is axially displaced against the post 40 and/or biased against the post 40. Moreover, embodiments of the biasing member 70 may be an O-ring configured to cooperate with the shoulder surface 58*a* forming part of the annular recess 56 proximate the second end 52 of connector body 50 and the outer internal wall 39 and lip 36 forming cavity 38 such that the biasing member 70 may make contact with and/or bias against the shoulder surface 58*a* forming part of the annular recess 56 (or other portions) of connector body 50 and outer internal wall 39 and lip 36 of coupling element 30. The biasing between the outer internal wall 39 and lip 36 of the coupling element 30 and the shoulder surface 58*a*, or proximate surfaces, forming the annular recess 56 of the connector body 50 can drive and/or bias the coupling element 30 in a substantially axial or axial direction towards the second end 2 of the connector 100 to make solid and constant contact with the post 40. For instance, the biasing member 70 can be sized and dimensioned large enough (e.g. oversized O-ring) such that when disposed in cavity 38, the biasing member 70 exerts enough force against both the coupling element 30 and the connector body 50 to axial displace the coupling element 30 a distance towards the post 40. Thus, the biasing member 70 may facilitate grounding of the connector 100, and attached coaxial cable 10 (shown in FIG. 2), by extending the electrical connection between the post 40 and the coupling element 30. Because the biasing member 70 may not be metallic and/or conductive, it may resist degradation, rust, corrosion, etc., to environmental elements when the connector 100 is exposed to such environmental elements. Furthermore, the resiliency of the biasing member 70 may deform under torque requirements, as opposed to permanently deforming in a manner similar to metallic or rigid components under similar torque requirements. Axial displacement of the connector body 50 may also occur, but the surface 49 of the post 40 may prevent axial displacement of the connector body 50, or friction fitting between the connector body 50 and the post 40 may prevent axial displacement of the connector body 50.

Figure 7:
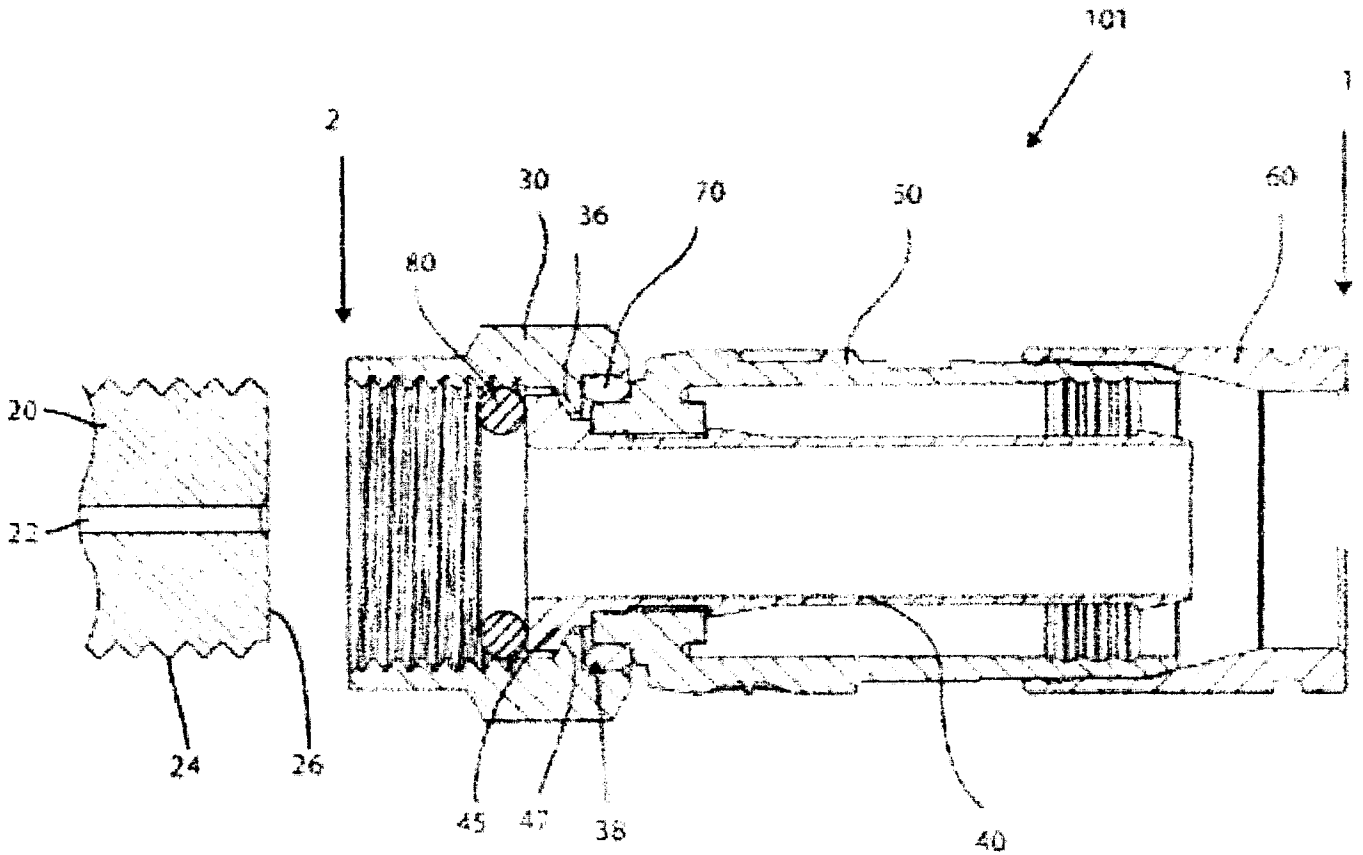
FIG. 7 depicts a cross-sectional view of a second embodiment of a coaxial cable connector.

With continued reference to the drawings, FIG. 7 depicts an embodiment of connector 101. Connector 101 may include post 40, coupling element 30, connector body 50, fastener member 60, biasing member 70, but may also include a mating edge conductive member 80 formed of a conductive material. Such materials may include, but are not limited to conductive polymers, conductive plastics, conductive elastomers, conductive elastomeric mixtures, composite materials having conductive properties, soft metals, conductive rubber, and/or the like and/or any operable combination thereof. The mating edge conductive member 80 may comprise a substantially circinate torus or toroid structure, and may be disposed within the internal portion of coupling element 30 such that the mating edge conductive member 80 may make contact with and/or reside continuous with a mating edge 46 of a post 40 when connector 101 is operably configured (e.g. assembled for communication with interface port 20). For example, one embodiment of the mating edge conductive member 80 may be an O-ring. The mating edge conductive member 80 may facilitate an annular seal between the coupling element 30 and post 40 thereby providing a physical barrier to unwanted ingress of moisture and/or other environmental contaminates. Moreover, the mating edge conductive member 80 may facilitate electrical coupling of the post 40 and coupling element 30 by extending therebetween an unbroken electrical circuit. In addition, the mating edge conductive member 80 may facilitate grounding of the connector 100, and attached coaxial cable (shown in FIG. 2), by extending the electrical connection between the post 40 and the coupling element 30. Furthermore, the mating edge conductive member 80 may effectuate a buffer preventing ingress of electromagnetic noise between the coupling element 30 and the post 40. The mating edge conductive member or O-ring 80 may be provided to users in an assembled position proximate the second end 42 of post 40, or users may themselves insert the mating edge conductive O-ring 80 into position prior to installation on an interface port 20. Those skilled in the art would appreciate that the mating edge conductive member 80 may be fabricated by extruding, coating, molding, injecting, cutting, turning, elastomeric batch processing, vulcanizing, mixing, stamping, casting, and/or the like and/or any combination thereof in order to provide efficient production of the component.

Figure 8A:
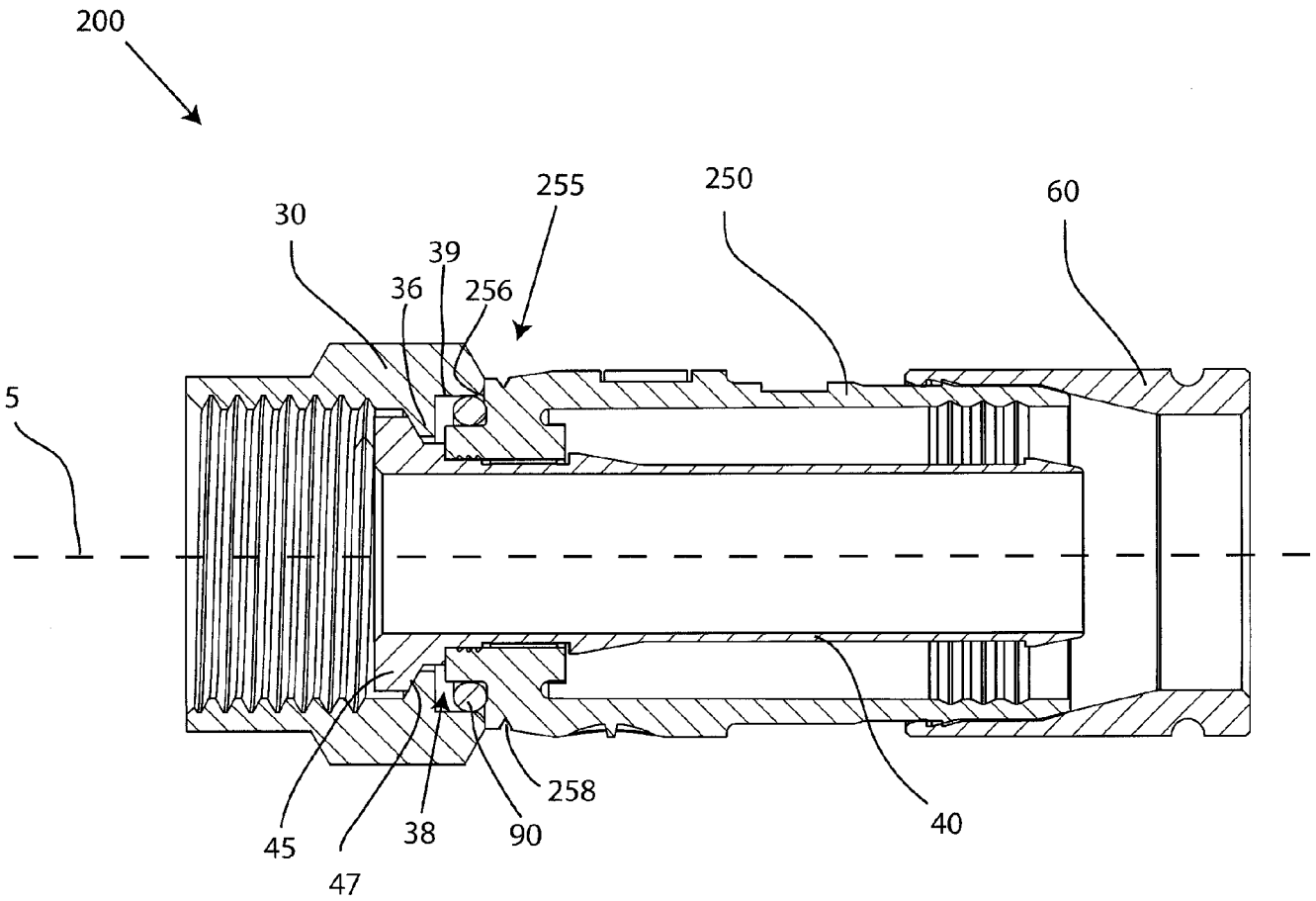
FIG. 8A depicts a cross-sectional view of vet another embodiment of a coaxial cable connector.
Figure 8B:
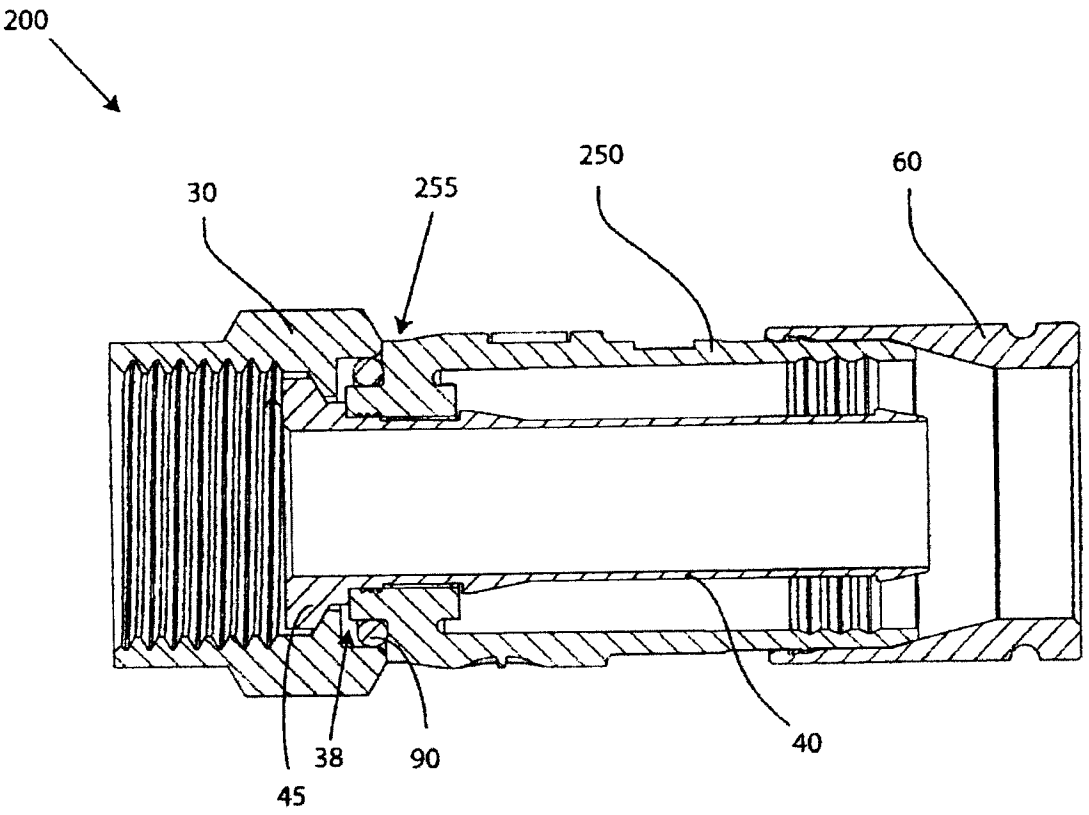
FIG. 8B depicts a cross-sectional view of a third embodiment of a coaxial cable connector.
Figure 8C:
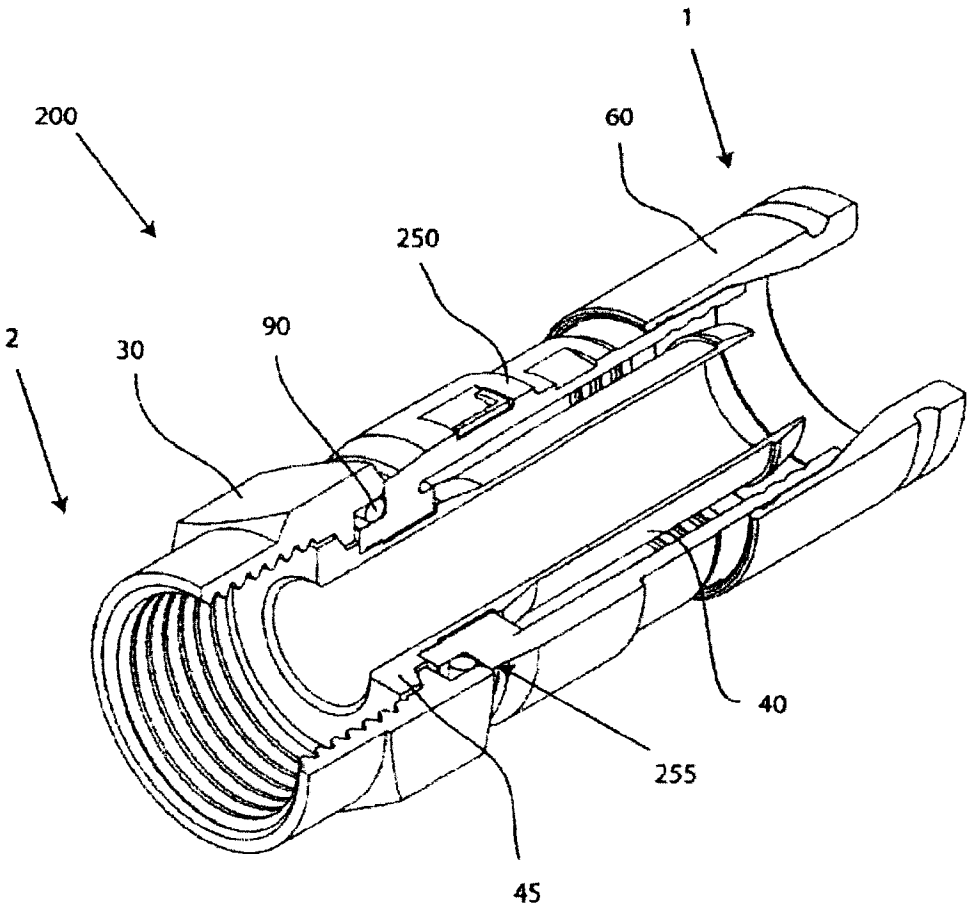
FIG. 8C depicts a perspective cut-away of the third embodiment of a coaxial cable connector.

Referring now to FIGS. 8A, 8B and 8C, an embodiment of connector 200 is described. Embodiments of connector 200 may include a post 40, a coupling element 30, a fastener member 60, a connector body 250 having biasing member 255, and a connector body member 90. Embodiments of the post 40, coupling element 30, and fastener member 60 described in association with connector 200 may share the same structural and functional aspects as described above in association with connectors 100, 101. Embodiments of connector 200 may also include a post 40 having a first end 41, a second end 42, and a flange 45 proximate the second end 42, wherein the post 40 is configured to receive a center conductor surrounded 18 by a dielectric 16 of a coaxial cable 10, a coupling element 30 attached to the post 40, the coupling element 30 having a first end 31 and a second end 32, and a connector body 250 having biasing member 255, wherein the engagement biasing member 255 biases the coupling element 30 against the post 40.

Figure 9:
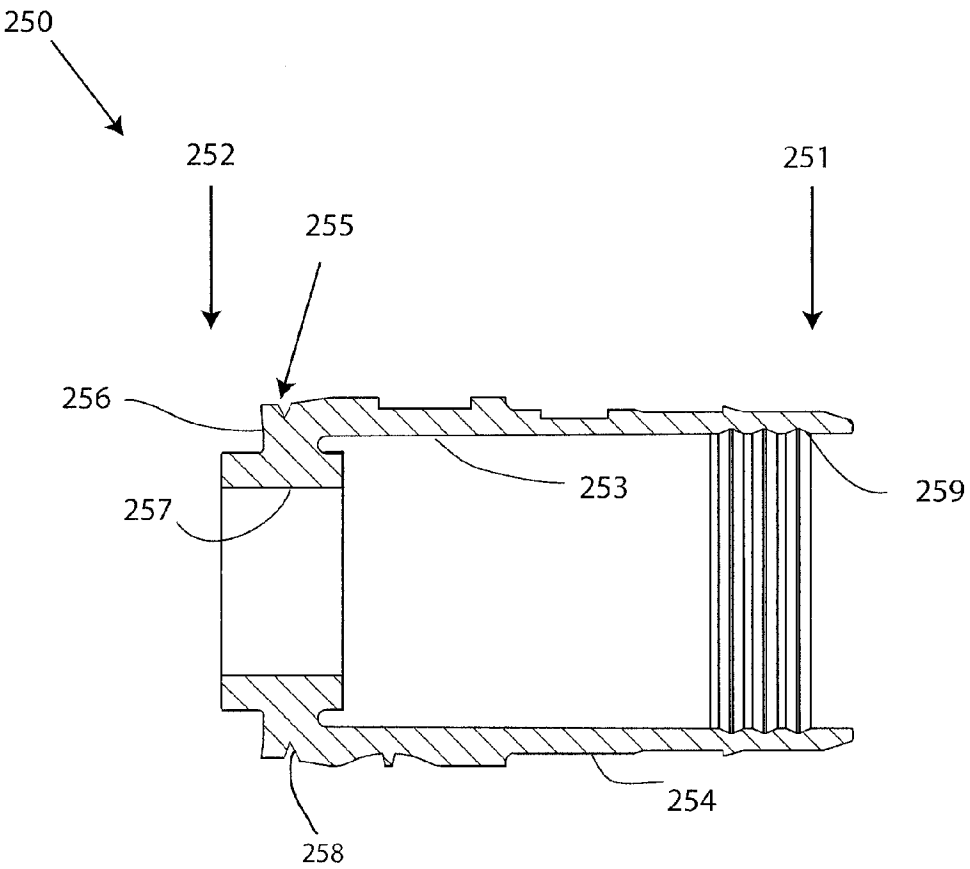
FIG.9 depicts a cross-sectional view of a second embodiment of a connector body.

With reference now to FIG. 9, and continued reference to FIGS. 8A, 8B, and 8C, embodiments of connector 200 may include a connector body 250 having a biasing member 255. The connector body 250 may include a first end 251, a second end 252, an inner surface 253, and an outer surface 254. Moreover, the connector body 250 may include a post mounting portion 257 proximate or otherwise near the second end 252 of the body 250; the post mounting portion 257 configured to securely locate the body 250 relative to a portion of the outer surface 44 of post 40, so that the connector body 250 is axially secured with respect to the post 40, in a manner that prevents the two components from moving with respect to each other in a direction parallel to the axis of the connector 200. In addition, the connector body 250 may include an extended, resilient wall 256*a* defined by an outer annular recess 256 located proximate or near the second end 252 of the connector body 250. The extended, resilient wall 256*a* may extend a radial distance with respect to a general axis 5 of the connector 200 to facilitate biasing engagement with the coupling element 30. For instance, the extended annular wall 256a may radially extend past the internal wall 39 of the coupling element 30. In one embodiment, the extended, resilient wall 256a may be a resilient extension of an annular shoulder formed by annular recess 56 of connector body 50.

In other embodiments, the extended, resilient annular recess 256, or shoulder, may function as a biasing member 255 proximate the second end 252. The biasing member 255 may be structurally integral with the connector body 250, such that the biasing member 255 is a portion of the connector body 250. In other embodiments, the biasing member 255 may be a separate component fitted or configured to be coupled with (e.g. adhered, snapped on, interference fit, and the like) an existing connector body, such as connector body 50. Moreover, the biasing member 255 of connector body 250 may be defined as a portion of the connector body 255, proximate the second end 252, that extends radially and potentially axially (slightly) from the body to bias the coupling element 30, proximate the first end 31, into contact with the post 40. The biasing member 255 may include a notch 258 to permit the necessary deflection to provide a biasing force to effectuate constant physical contact between the lip 36 of the coupling element 30 and the outer tapered surface 47 of the flange 45 of the post 40. The notch 258 may be a notch, groove, channel, or similar annular void that results in an annular portion of the connector body 50 that is removed to permit deflection in an axial direction with respect to the general axis 5 of connector 200.

Accordingly, a portion of the extended, resilient annular recess 256, or the biasing member 255, may engage the coupling element 30 to bias the coupling element 30 into contact with the post 40. Contact between the coupling element 30 and the post 40 may promote continuity through the connector 200, reduce/eliminate RF leakage, and ensure a stable ground through the connection of the connector 200 to an interface port 20 in the event the connector 200 is not fully tightened onto the port 20. In most embodiments, the extended annular recess 256 or the biasing member 255 of the connector body 250 may provide a constant biasing force behind the coupling element 30. The biasing force provided by the extended annular recess 256, or biasing member 255, behind the coupling element 30 may result in constant contact between the lip 36 of the coupling element 30 and the outward tapered surface 47 of the post 40. However, the biasing force of the extending annular recess 256, or biasing member 255, may not (significantly) hinder or prevent the rotational movement of the coupling element 30 (i.e. rotation of the coupling element 30 about the post 40). Because connector 200 may include connector body 250 having an extended, resilient annular recess 256 to improve continuity, there may be no need for an additional component such as a metallic conductive continuity member that is subject to corrosion and permanent deformation during operable advancement and disengagement with an interface port 20, which may ultimately adversely affect the signal quality (e.g. corrosion or deformation of conductive member may degrade the signal quality)

Furthermore, the connector body 250 may include a semi-rigid, yet compliant outer surface 254, wherein the outer surface 254 may be configured to form an annular seal when the first end 251 is deformably compressed against a received coaxial cable 10 by operation of a fastener member 60. Further still, the connector body 250 may include internal surface features 259, such as annular serrations formed near or proximate the internal surface of the first end 251 of the connector body 250 and configured to enhance frictional restraint and gripping of an inserted and received coaxial cable 10, through tooth-like interaction with the cable. The connector body 250 may be formed of materials such as plastics, polymers, bendable metals or composite materials that facilitate a semi-rigid, yet compliant outer surface 254. Further, the connector body 250 may be formed of conductive or non-conductive materials or a combination thereof. Manufacture of the connector body 250 may include casting, extruding, cutting, turning, drilling, knurling, injection molding, spraying, blow molding, component overmolding, combinations thereof, or other fabrication methods that may provide efficient production of the component.

Further embodiments of connector 200 may include a connector body member 90 formed of a conductive or non-conductive material. Such materials may include, but are not limited to conductive polymers, plastics, elastomeric mixtures, composite materials having conductive properties, soft metals, conductive rubber, rubber, and/or the like and/or any workable combination thereof. The connector body member 90 may comprise a substantially circinate torus or toroid structure, or other ring-like structure. For example, an embodiment of the connector body member 90 may be an O-ring disposed proximate the second end 254 of connector body 250 and the cavity 38 extending axially from the edge of first end 31 and partially defined and bounded by an outer internal wall 39 of coupling element 30 (see FIG. 4) such that the connector body O-ring 90 may make contact with and/or reside contiguous with the extended annular recess 256 of connector body 250 and outer internal wall 39 of coupling element 30 when operably attached to post 40 of connector 200. The connector body member 90 may facilitate an annular seal between the coupling element 30 and connector body 250 thereby providing a physical barrier to unwanted ingress of moisture and/or other environmental elements. Moreover, the connector body member 90 may facilitate further electrical coupling of the connector body 250 and coupling element 30 by extending therebetween an unbroken electrical circuit if connector body member 90 is conductive (i.e. formed of conductive materials). In addition, the connector body member 90 may further facilitate grounding of the connector 200, and attached coaxial cable 10 by extending the electrical connection between the connector body 250 and the coupling element 30. Furthermore, the connector body member 90 may effectuate a buffer preventing ingress of electromagnetic noise between the coupling element 30 and the connector body 250. It should be recognized by those skilled in the relevant art that the connector body member 90 may be manufactured by extruding, coating, molding, injecting, cutting, turning, elastomeric batch processing, vulcanizing, mixing, stamping, casting, and/or the like and/or any combination thereof in order to provide efficient production of the component.

Figure 10:
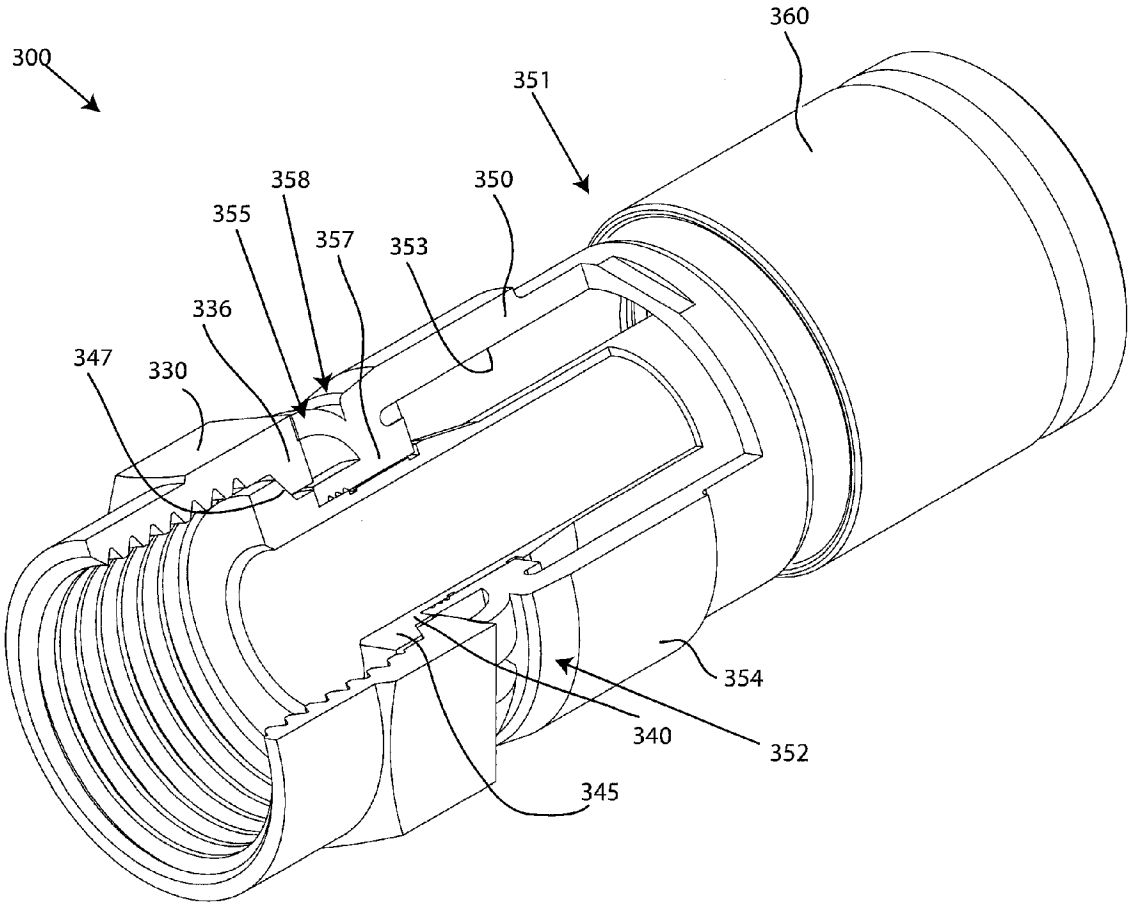
FIG. 10 depicts a perspective, cut-away view of a fourth embodiment of a coaxial cable connector.
Figure 11:
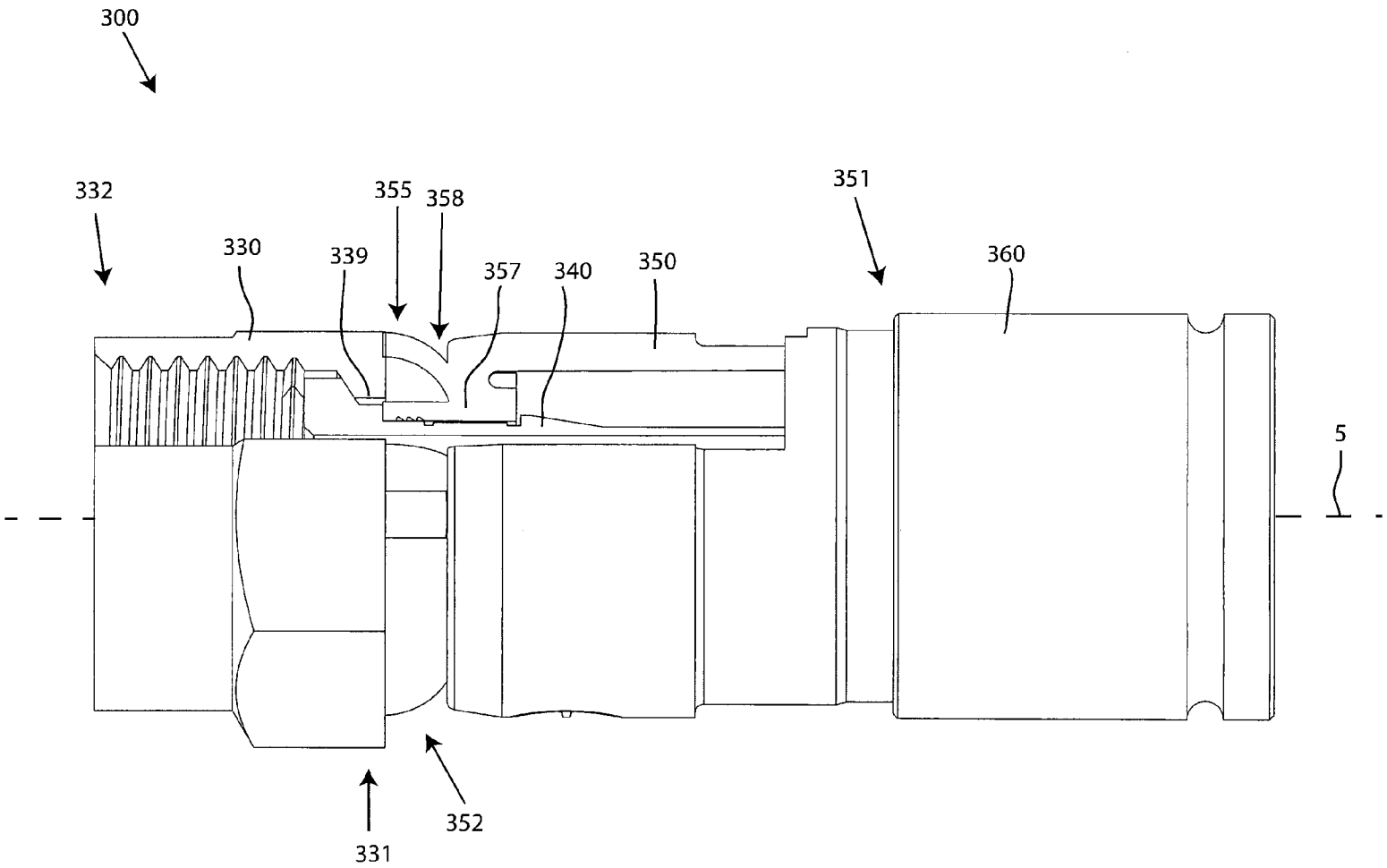
FIG. 11 depicts a partial cross-section view of the fourth embodiment of the coaxial cable connector.
Figure 12:
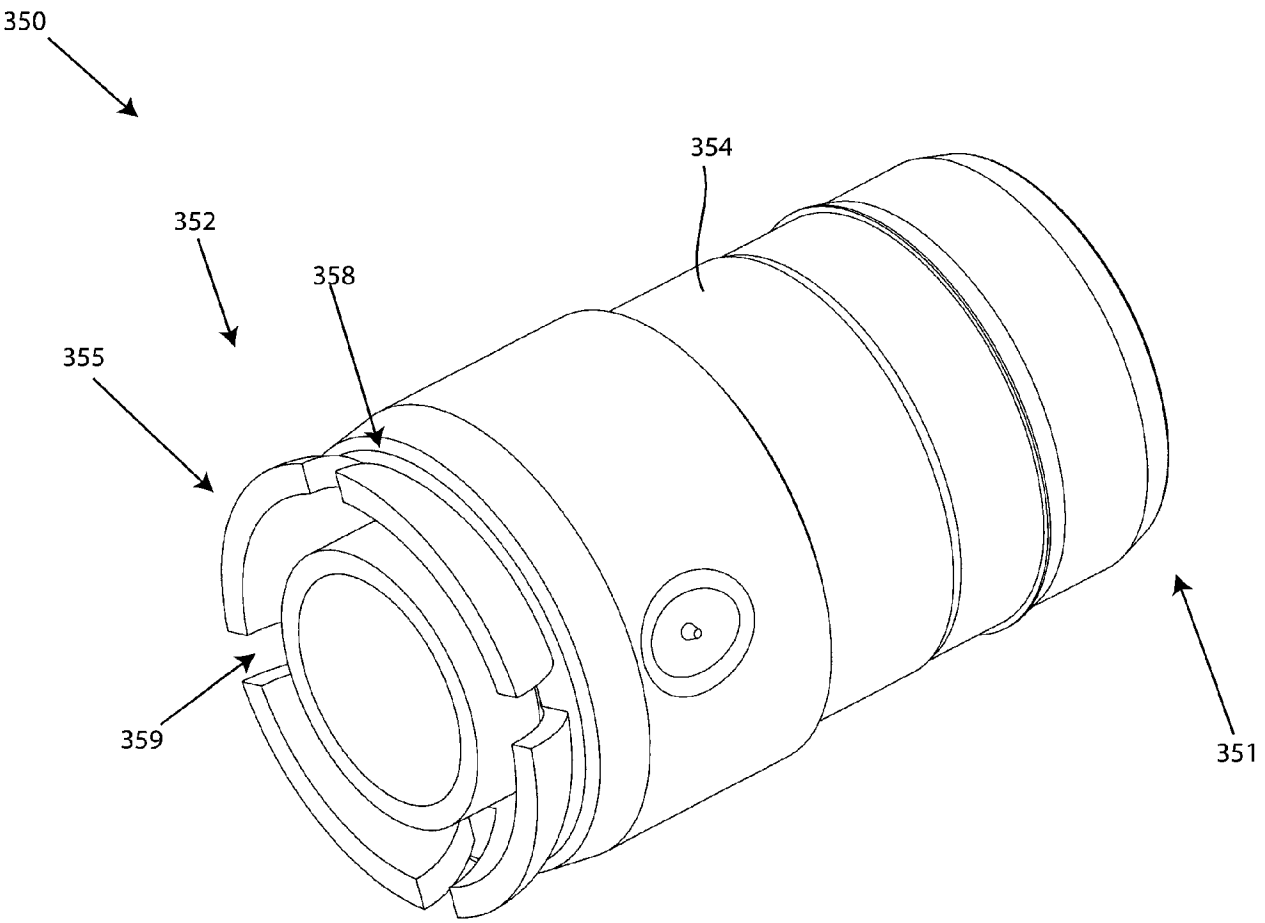
FIG. 12 depicts a perspective view of a third embodiment of the connector body.
Figure 13:
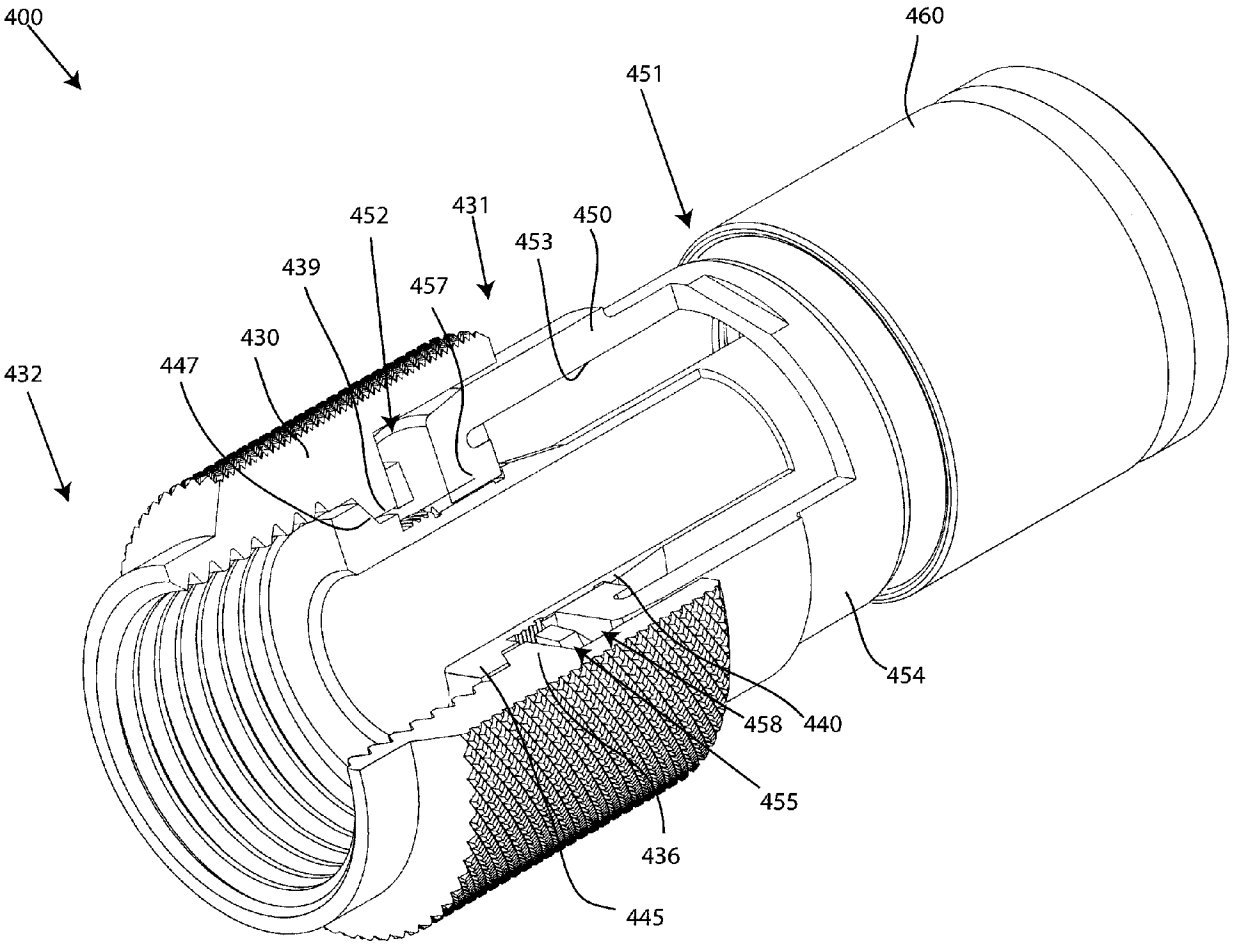
FIG. 13 depicts a perspective, cut-away view of a fifth embodiment of a coaxial cable connector, wherein an embodiment of a coupling member has an external knurled surface.
Figure 14:
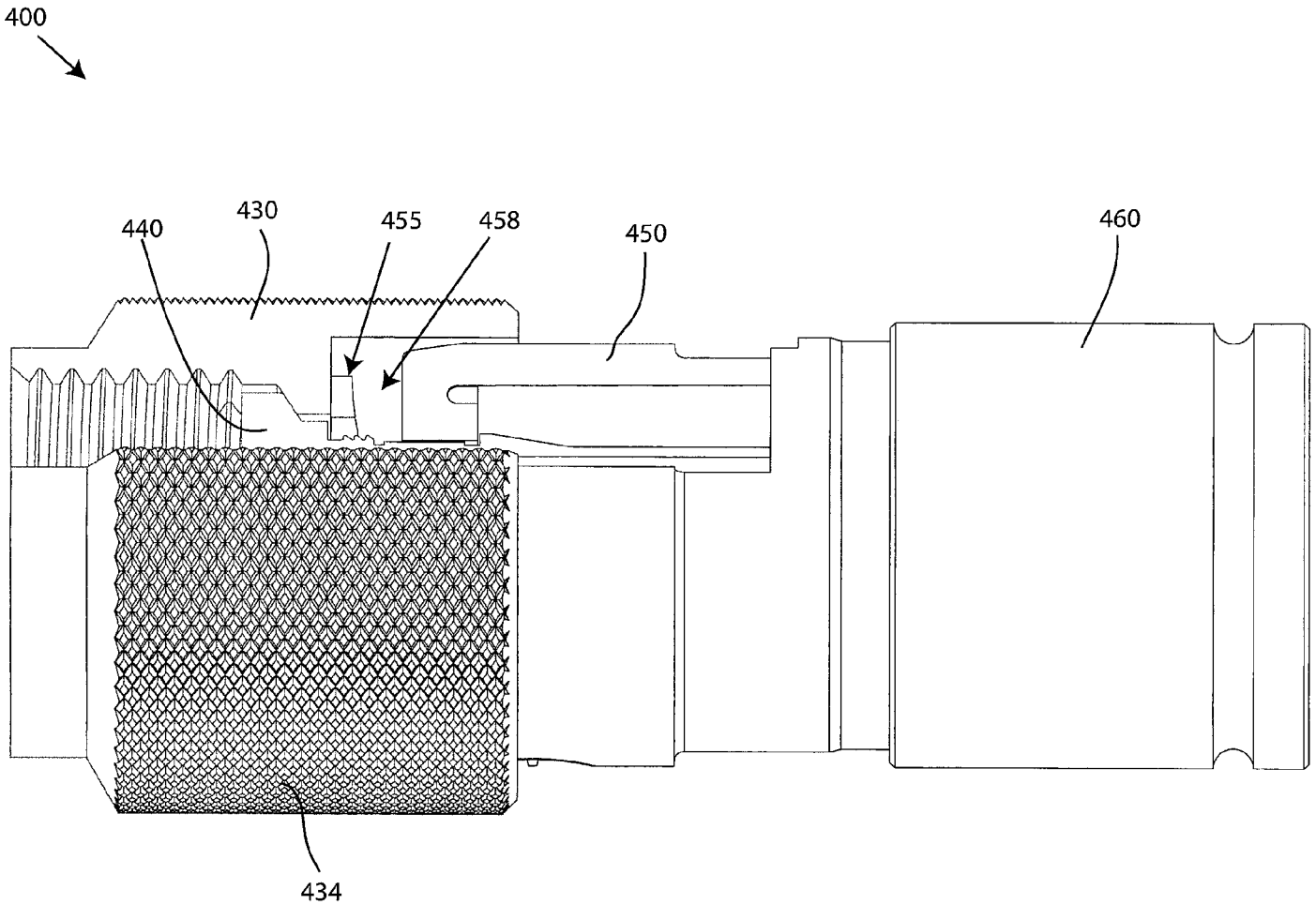
FIG. 14 depicts a partial cross-section view of the fifth embodiment of the coaxial cable connector, wherein an embodiment of a coupling member has an external knurled surface.
Figure 15:
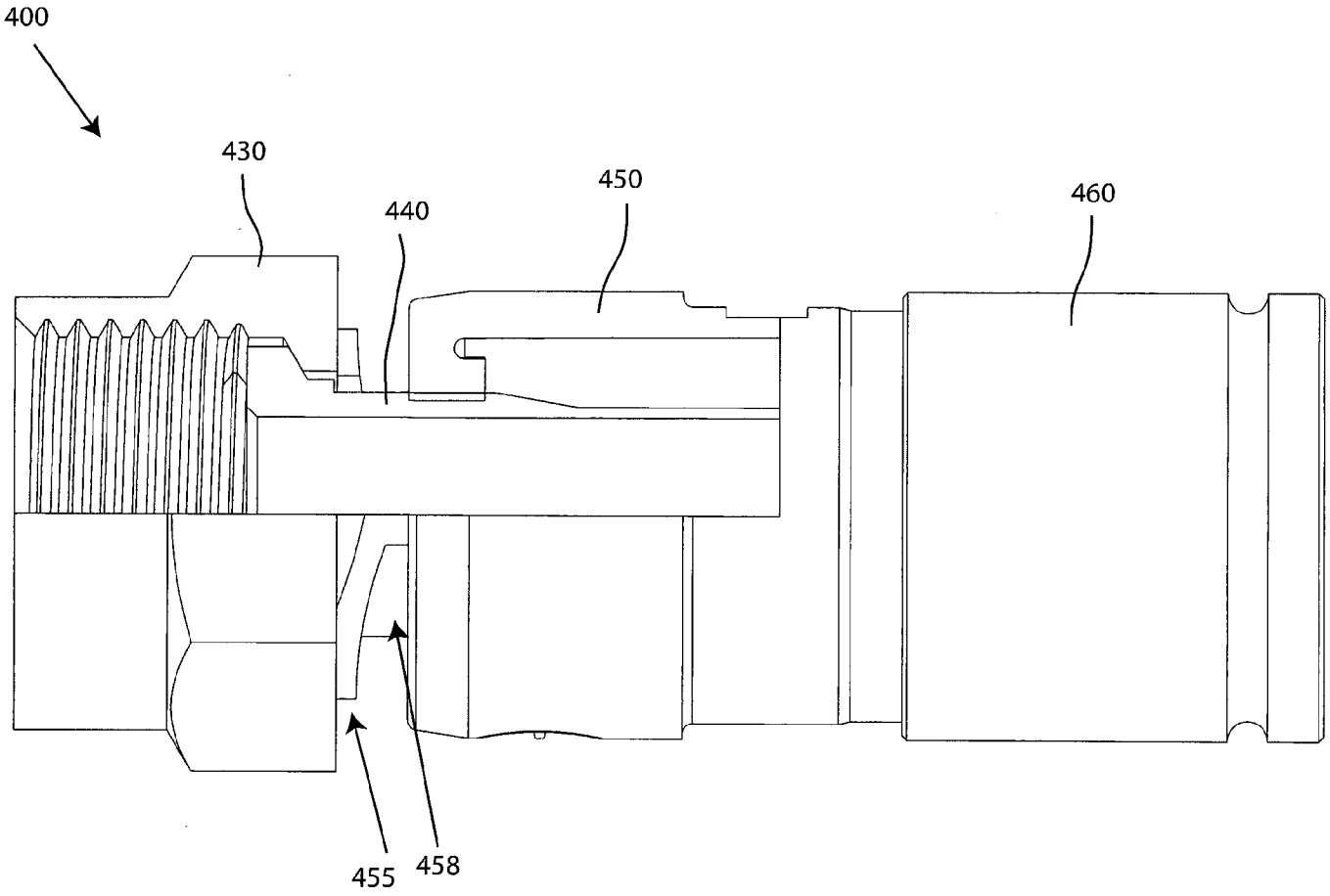
FIG. 15 depicts a partial cross-section view of the fifth embodiment of the coaxial cable connector.
Figure 16:
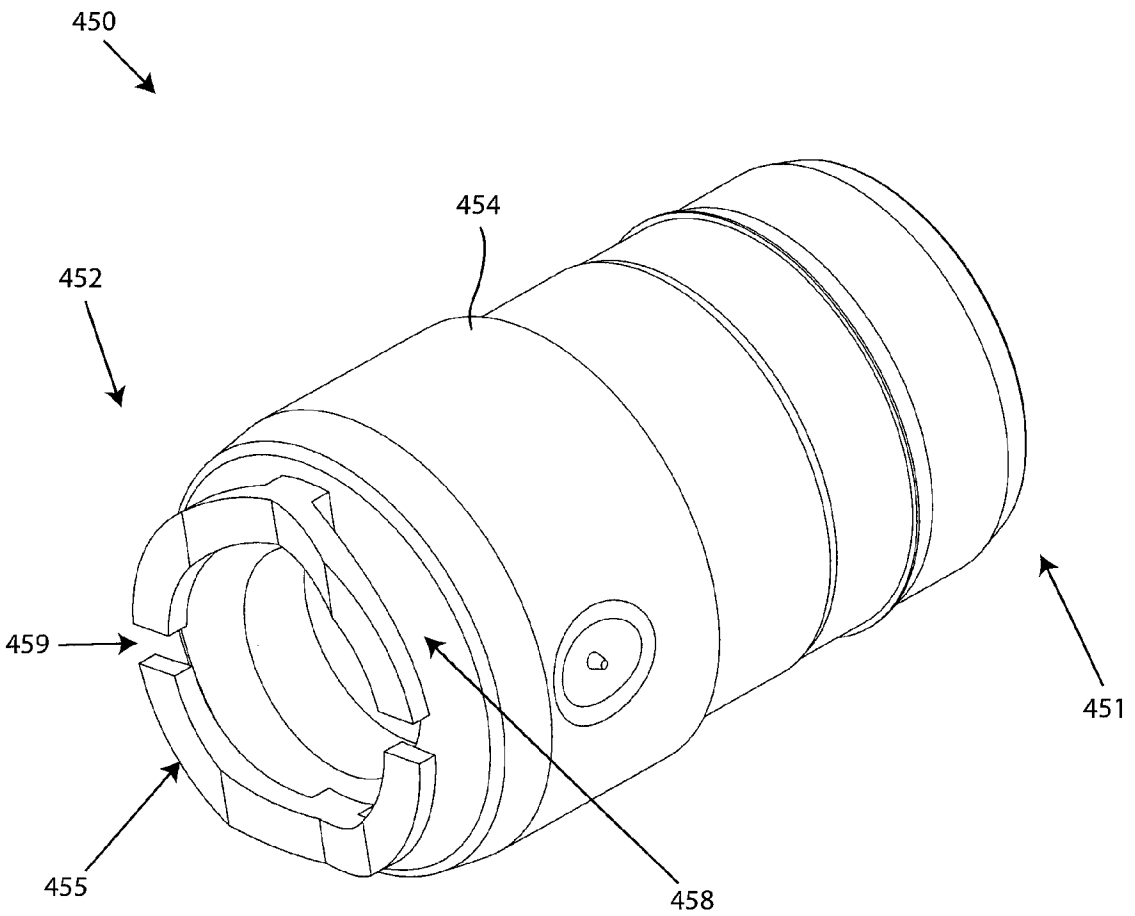
FIG. 16 depicts a perspective view of a fourth embodiment of a connector body.

Referring now to FIGS. 10-12, an embodiment of connector 300 is described. Embodiments of connector 300 may include a post 340, a coupling element 330, a fastener member 360, and a connector body 350 having biasing member 355. Embodiments of the post 340, coupling element 330, and fastener member 360 described in association with connector 300 may share the same structural and functional aspects of post 240, coupling element 230, and connector body 250 described above in association with connector 200.

Embodiments of connector 300 may include a connector body 350 having a biasing member 355. The connector body 350 may include a first end 351, a second end 352, an inner surface 353, and an outer surface 354. Moreover, the connector body 350 may include a post mounting portion 357 proximate or otherwise near the second end 352 of the body 350; the post mounting portion 357 configured to securely locate the body 350 relative to a portion of the outer surface of post 340, so that the connector body 350 is axially secured with respect to the post 340, in a manner that prevents the two components from moving with respect to each other in a direction parallel to the axis of the connector 300. In addition, the connector body 350 may include a biasing member 355.

Embodiments of the biasing member 355 may be a resilient, extended portion of the connector body 350 proximate or near the second end 352 of the connector body 350. Other embodiments of the biasing member 355 may be one or more resilient fingers arcuately extending from the second end 352 of the connector body 350; the one or more resilient fingers may be separated by one or openings 359, wherein the openings 359 may be slits, slots, openings, grooves, voids, and the like. The resilient, extended portion(s) of the connector body 350 forming the biasing member 355 may extend a radial distance with respect to a general, central axis 5 of the connector 300 to facilitate biasing engagement with the coupling element 330. For instance, the biasing member 355 may extend past the wall 39 of the coupling element 330. In addition, embodiments of the biasing member 355 may be structurally integral with the connector body 350, such that the biasing member 355 is a portion of the connector body 350. In other embodiments, the biasing member 355 may be a separate component fitted or configured to be coupled with (e.g. adhered, snapped on, interference fit, and the like) an existing connector body, such as connector body 350. Moreover, the biasing member 355 of connector body 350 may be defined as a portion of the connector body 355, proximate the second end 352, that extends radially and potentially axially from the body to bias the coupling element 330, proximate the first end 331, into contact with the post 340. The biasing member 355 may include a notch 358 to permit the necessary deflection of the biasing member 355 to provide a biasing force to effectuate constant physical contact between the lip 336 of the coupling element 330 and the outer tapered surface 347 of the flange 345 of the post 340. The notch 358 may be a notch, groove, channel, or similar annular void that results in an annular or semi-annular portion of the connector body 350 that is removed to permit deflection in an axial direction with respect to the general axis 5 of connector 300.

Accordingly, an extended portion of the connector body 350, such as the biasing member 355, may engage the coupling element 330 to bias the coupling element 330 into contact with the post 340. Contact between the coupling element 330 and the post 340 may promote continuity through the connector 300, reduce/eliminate RF leakage and/or interference, and ensure a stable ground through the connection of the connector 300 to an interface port regardless if the connector 300 is fully tightened onto the port. In most embodiments, the biasing member 355 of the connector body 350 may provide a constant biasing force behind the coupling element 330. The biasing force provided by the biasing member 355, behind the coupling element 330 may result in constant contact between the lip 336 of the coupling element 330 and the outward tapered surface 347 of the post 340. However, the biasing force of the biasing member 355, may not (significantly) hinder or prevent the rotational movement of the coupling element 330 (i.e. rotation of the coupling element 330 about the post 340). Because connector 300 may include a connector body 350 having an extended, resilient portion to improve continuity, there may be no need for an additional component such as a metallic conductive continuity member that is subject to corrosion and permanent deformation during operable advancement and disengagement with an interface port 20, which may ultimately adversely affect the signal quality (e.g. corrosion or deformation of conductive member may degrade the signal quality)

Furthermore, the connector body 350 may include a semi-rigid, yet compliant outer surface 354, wherein the outer surface 354 may be configured to form an annular seal when the first end 351 is deformably compressed against a received coaxial cable 10 by operation of a fastener member 360. Further still, the connector body 350 may include internal surface features, such as annular serrations formed near or proximate the internal surface of the first end 351 of the connector body 350 and configured to enhance frictional restraint and gripping of an inserted and received coaxial cable 10, through tooth-like interaction with the cable. The connector body 350 may be formed of materials such as plastics, polymers, bendable metals or composite materials that facilitate a semi-rigid, yet compliant outer surface 354. Further, the connector body 350 may be formed of conductive or non-conductive materials or a combination thereof. Manufacture of the connector body 350 may include casting, extruding, cutting, turning, drilling, knurling, injection molding, spraying, blow molding, component overmolding, combinations thereof, or other fabrication methods that may provide efficient production of the component.

Referring now to FIGS. 13-16, an embodiment of connector 400 is described. Embodiments of connector 400 may include a post 440, a coupling element 430, a fastener member 460, and a connector body 450 having biasing member 455. Embodiments of the post 440, coupling element 430, and fastener member 460 described in association with connector 400 may share the same structural and functional aspects of post 240, 340, coupling element 230, 330, and connector body 250, 330 described above in association with connectors 200, 300.

Embodiments of connector 400 may include a connector body 450 having a biasing member 455. The connector body 450 may include a first end 451, a second end 452, an inner surface 453, and an outer surface 454. Moreover, the connector body 450 may include a post mounting portion 457 proximate or otherwise near the second end 452 of the body 450; the post mounting portion 457 configured to securely locate the body 450 relative to a portion of the outer surface of post 440, so that the connector body 450 is axially secured with respect to the post 440, in a manner that prevents the two components from moving with respect to each other in a direction parallel to the axis of the connector 400. In addition, the connector body 450 may include a biasing member 455. Embodiments of the biasing member 455 may be a resilient, extended portion of the connector body 450 proximate or near the second end 452 of the connector body 450. Other embodiments of the biasing member 455 may be one or more resilient fingers arcuately extending from the second end 452 of the connector body 450; the one or more resilient fingers may be separated by one or openings 459, wherein the openings 459 may be slits, slots, openings, grooves, voids, and the like. The resilient, extended portion(s) of the connector body 450 forming the biasing member 455 may extend a radial distance with respect to a general, central axis 5 of the connector 400 to facilitate biasing engagement with the coupling element 430. For instance, the biasing member 455 may extend past the wall 439 of the coupling element 430. In addition, embodiments of the biasing member 455 may be structurally integral with the connector body 450, such that the biasing member 455 is a portion of the connector body 450. In other embodiments, the biasing member 455 may be a separate component fitted or configured to be coupled with (e.g. adhered, snapped on, interference fit, and the like) an existing connector body, such as connector body 450. Moreover, the biasing member 455 of connector body 450 may be defined as a portion of the connector body 455, proximate the second end 452, that extends radially and potentially axially from the body to bias the coupling element 430, proximate the first end 431, into contact with the post 440. The biasing member 455 may include a notch 458 to permit the necessary deflection of the biasing member 455 to provide a biasing force to effectuate constant physical contact between the lip 436 of the coupling element 430 and the outer tapered surface 447 of the flange 445 of the post 440. The notch 458 may be a notch, groove, channel, or similar annular void that results in an annular or semi-annular portion of the connector body 450 that is removed to permit deflection in an axial direction with respect to the general axis 5 of connector 400.

Accordingly, an extended portion of the connector body 450, such as the biasing member 455, may engage the coupling element 430 to bias the coupling element 430 into contact with the post 440. Contact between the coupling element 430 and the post 440 may promote continuity through the connector 400, reduce/eliminate RF leakage and/or interference, and ensure a stable ground through the connection of the connector 400 to an interface port regardless if the connector 400 is fully tightened onto the port. In most embodiments, the biasing member 455 of the connector body 450 may provide a constant biasing force behind the coupling element 430. The biasing force provided by the biasing member 455, behind the coupling element 430 may result in constant contact between the lip 436 of the coupling element 430 and the outward tapered surface 447 of the post 440. However, the biasing force of the biasing member 455, may not (significantly) hinder or prevent the rotational movement of the coupling element 430 (i.e. rotation of the coupling element 430 about the post 440). Because connector 400 may include a connector body 450 having an extended, resilient portion to improve continuity, there may be no need for an additional component such as a metallic conductive continuity member that is subject to corrosion and permanent deformation during operable advancement and disengagement with an interface port, which may ultimately adversely affect the signal quality (e.g. corrosion or deformation of conductive member may degrade the signal quality).

Furthermore, the connector body 450 may include a semi-rigid, yet compliant outer surface 454, wherein the outer surface 454 may be configured to form an annular seal when the first end 451 is deformably compressed against a received coaxial cable 10 by operation of a fastener member 460. Further still, the connector body 450 may include internal surface features, such as annular serrations formed near or proximate the internal surface of the first end 451 of the connector body 450 and configured to enhance frictional restraint and gripping of an inserted and received coaxial cable 10, through tooth-like interaction with the cable. The connector body 450 may be formed of materials such as plastics, polymers, bendable metals or composite materials that facilitate a semi-rigid, yet compliant outer surface 454. Further, the connector body 450 may be formed of conductive or non-conductive materials or a combination thereof. Manufacture of the connector body 450 may include casting, extruding, cutting, turning, drilling, knurling, injection molding, spraying, blow molding, component overmolding, combinations thereof, or other fabrication methods that may provide efficient production of the component.

Figure 17:
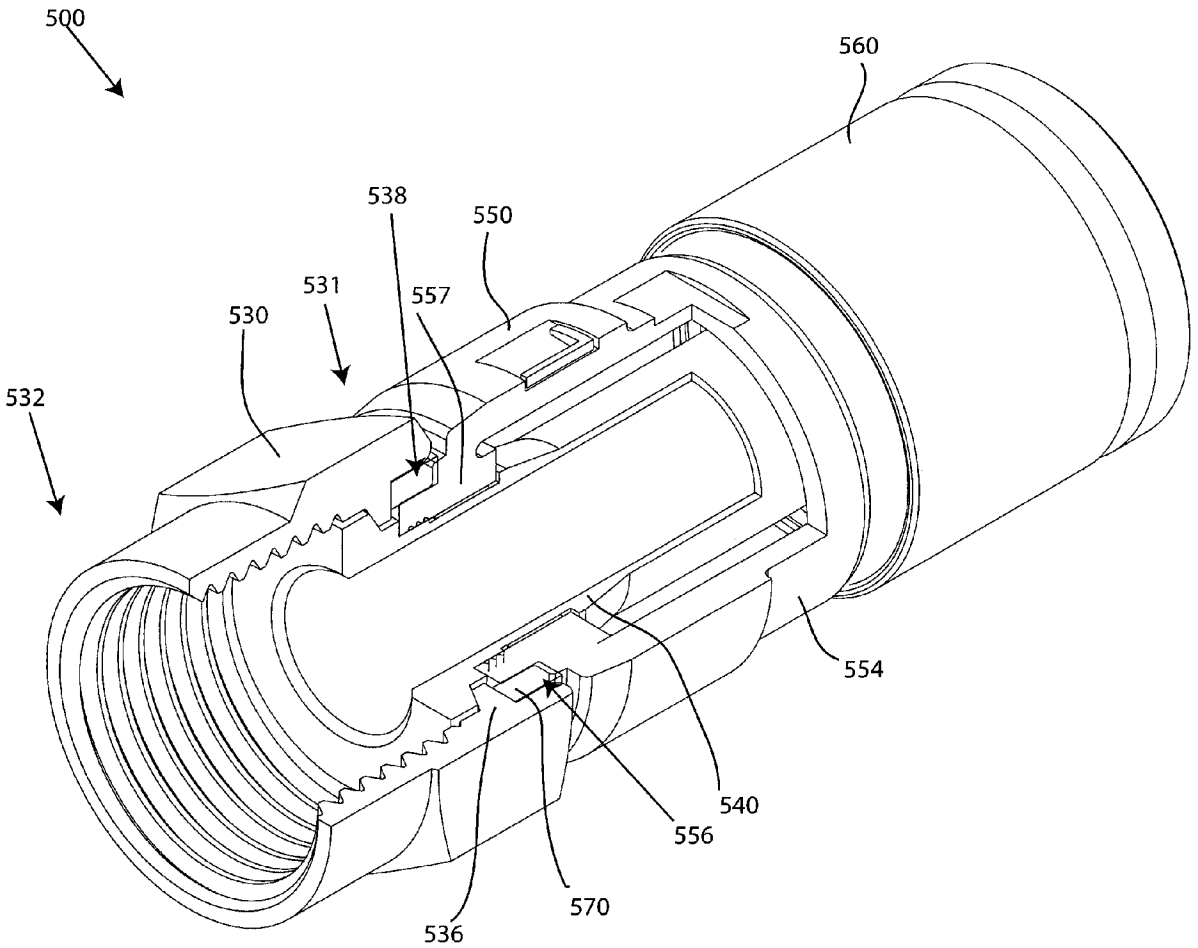
FIG. 17 depicts a perspective, cut-away view of a sixth embodiment of a coaxial cable connector.
Figure 18:
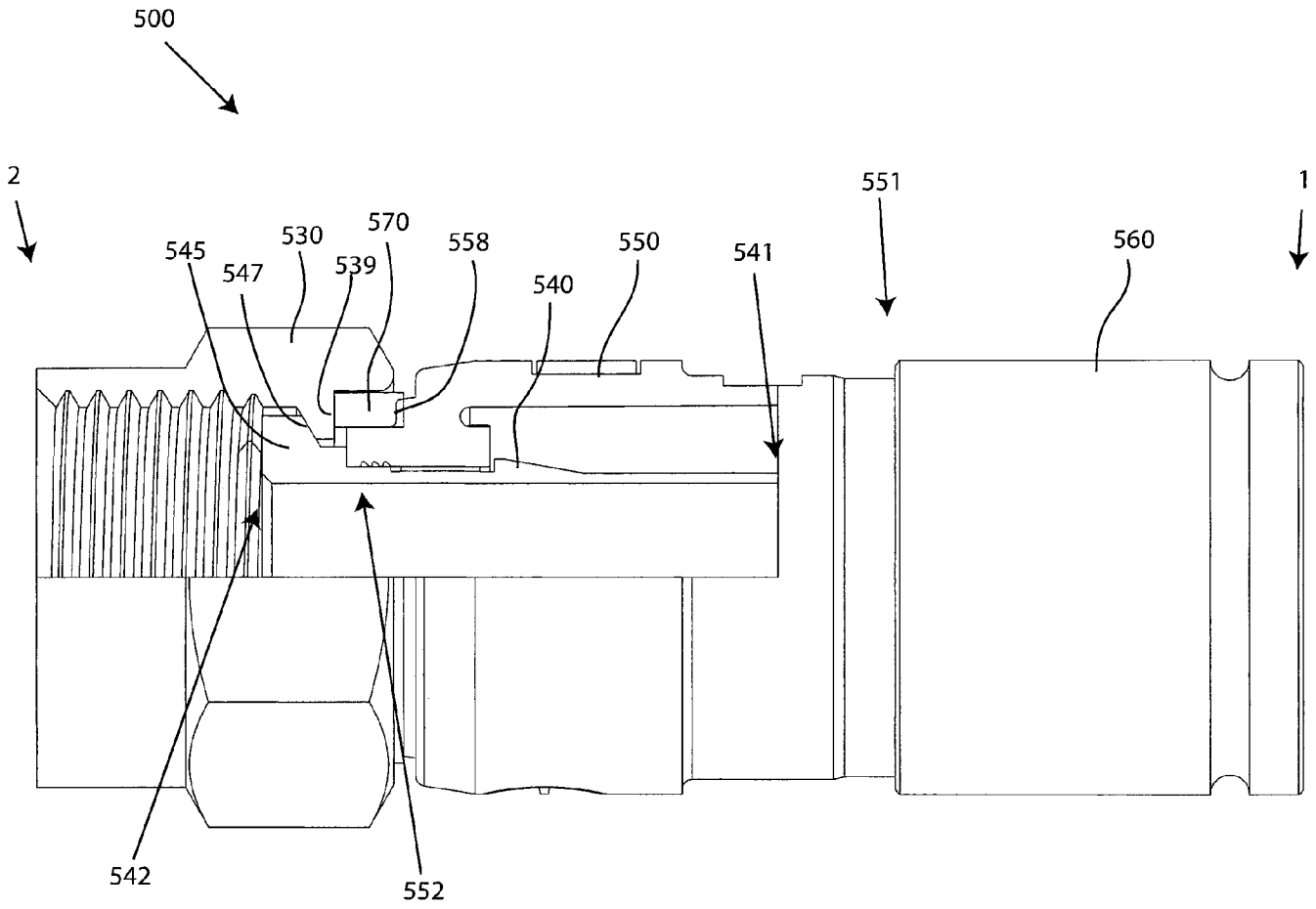
FIG. 18 depicts a partial cross-section view of a sixth embodiment of the coaxial cable connector.

With reference now to FIGS. 17 and 18, an embodiment of connector 500 is described. Embodiments of connector 500 may include a post 540, a coupling element 530, a fastener member 560, and a connector body 550. Embodiments of the post 540, coupling element 530, connector body 550, and fastener member 560 described in association with connector 500 may share the same structural and functional aspects of post 40, coupling element 30, connector body 50, and fastener member 60 described above in association with connectors 100, 101. Embodiments of connector 500 may also include a biasing member 570 to bias the coupling member 530 against the post 540.

Moreover, embodiments of a coaxial cable connector 500 can include a biasing member 570. The biasing member 570 may be formed of a non-metallic material to avoid rust, corrosion, deterioration, and the like, caused by environmental elements, such as water and moisture. Additional materials the biasing member 570 may be formed of may include, but are not limited to, polymers, plastics, elastomers, elastomeric mixtures, composite materials, rubber, and/or the like and/or any operable combination thereof. The biasing member 570 may be a resilient, rigid, semi-rigid, flexible, or elastic member, component, element, and the like. The resilient nature of the biasing member 570 may help avoid permanent deformation while under the torque requirements when a connector 500 is advanced onto an interface port 20.

Moreover, the biasing member 570 may facilitate constant contact between the coupling element 530 and the post 540. For instance, the biasing member 570 may bias, provide, force, ensure, deliver, etc. the contact between the coupling element 530 and the post 540. The constant contact between the coupling element 530 and the post 540 promotes continuity through the connector 500, reduces/eliminates RF leakage and/or interference, and ensures a stable ground through the connection of a connector 500 to an interface port 20 in the event the connector 500 is not fully tightened onto the port 20. To establish and maintain solid, constant contact between the coupling element 530 and the post 540, the biasing member 570 may be disposed behind the coupling element 530, proximate or otherwise near the second end 552 of the connector body 550. In other words, the biasing member 570 may be disposed within the cavity 538 formed between the coupling element 530 and the annular recess 556 of the connector body 550. The biasing member 570 can provide a biasing force against the coupling element 530, which may axially displace the coupling element 530 into constant direct contact with the post 540. In particular, the disposition of a biasing member 570 in annular cavity 538 proximate the second end 552 of the connector body 550 may axially displace the coupling element 530 towards the post 540, wherein the lip 536 of the coupling element 530 directly contacts the outer tapered surface 547 of the flange 545 of the post 540. The location and structure of the biasing member 570 may promote continuity between the post 540 and the coupling element 530, but may not impede the rotational movement of the coupling element 530 (e.g. rotational movement about the post 540). The biasing member 570 may also create a barrier against environmental elements, thereby preventing environmental elements from entering the connector 500. Those skilled in the art would appreciate that the biasing member 570 may be fabricated by extruding, coating, molding, injecting, cutting, turning, elastomeric batch processing, vulcanizing, mixing, stamping, casting, and/or the like and/or any combination thereof in order to provide efficient production of the component.

Embodiments of biasing member 570 may include an annular or semi-annular resilient member or component configured to physically and electrically couple the post 540 and the coupling element 530. One embodiment of the biasing member 570 may be a substantially rectangular cross-sectioned collar, or other ring-like structure having a cross-sectional area large enough that when disposed within annular cavity 538 proximate the annular recess 556 of the connector body 550, the coupling element 530 is axially displaced against the post 540 and/or biased against the post 540. Moreover, embodiments of the biasing member 570 may be resilient collar member configured to cooperate with the annular recess 556 proximate the second end 552 of connector body 550 and the outer internal wall 539 and lip 536 forming cavity 538 such that the biasing member 570 may make contact with and/or bias against a shoulder surface 558 forming a part of the annular recess 556 of connector body 550 and outer internal wall 539 and lip 536 of coupling element 530. The biasing between the outer internal wall 539 and lip 356 of the coupling element 530 and the shoulder surface 558 forming part of the annular recess 556, and surrounding portions, of the connector body 550 can drive and/or bias the coupling element 530 in a substantially axial or axial direction towards the second end 2 of the connector 500 to make solid and constant contact with the post 540. For instance, the biasing member 570 can be sized and dimensioned large enough (e.g. oversized collar) such that when disposed in cavity 538, the biasing member 570 exerts enough force against both the coupling element 530 and the connector body 550 to axial displace the coupling element 530 a distance towards the post 540. Thus, the biasing member 570 may facilitate grounding of the connector 500, and attached coaxial cable 10 (shown in FIG. 2), by extending the electrical connection between the post 540 and the coupling element 530. Because the biasing member 570 may not be metallic and/or conductive, it may resist degradation, rust, corrosion, etc., to environmental elements when the connector 500 is exposed to such environmental elements. Furthermore, the resiliency of the biasing member 570 may deform under torque requirements, as opposed to permanently deforming in a manner similar to metallic or rigid components under similar torque requirements. Axial displacement of the connector body 550 may also occur, but the surface of the post 540 may prevent axial displacement of the connector body 550, or friction fitting between the connector body 550 and the post 540 may prevent axial displacement of the connector body 550.

Referring to FIGS. 1-18, a method of facilitating continuity through a coaxial cable connector 100, 500 may include the steps of providing a post 40, 540 having a first end 41, 541 a second end 42, 542 and a flange 45, 545 proximate the second end 42, 542 wherein the post 40, 540 is configured to receive a center conductor 18 surrounded by a dielectric 16 of a coaxial cable 10, a connector body 50, 550 attached to the post 40, 540 and a coupling element 30, 530 attached to the post 40, 540 the coupling element 30, 530 having a first end 31, 531 and a second end 32, 532 and disposing a biasing member 70, 570 within a cavity 38, 538 formed between the first end 31, 531 of the coupling element 30, 530 and the connector body 50, 550 to bias the coupling element 30, 530 against the post 40, 540. Furthermore, a method of facilitating continuity through a coaxial cable connector 200, 300, 400 may include the steps of providing a post 240, 340, 440 having a first end 241, 341, 441 a second end 242, 342, 442 and a flange 245, 345, 445 proximate the second end 242, 342, 442 wherein the post 240, 340, 540 is configured to receive a center conductor 18 surrounded by a dielectric 16 of a coaxial cable 10, a coupling element 230. 330, 430 attached to the post 240, 340, 440, the coupling element 230, 330, 430 having a first end 231, 331, 431 and a second end 232, 332, 432, and a connector body 250, 350, 450 having a first end 251, 351. 451, a second end 252,352, 352, and extending a portion of the connector body 250, 350, 450 a distance to engage the coupling element 230, 330, 430, wherein the extended portion is a resilient biasing member 255, 355, 455, further wherein the engagement between the biasing member 255, 355, 455 and the coupling element 230, 330, 430 biases the coupling element 230, 330, 430 against the post 240, 340, 440.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A coaxial cable connector comprising:

a post having a first end, a second end, and a flange, wherein the post is configured to receive a center conductor surrounded by a dielectric of a coaxial cable;

a coupling element configured to engage the post and configured to move between a first position, where, as the coupling element is tightened onto an interface port, the post does not contact the interface port, and a second position, where, as the coupling element is tightened onto the interface port, the post contacts the interface port, the second position being axially spaced from the first position, the coupling element having a first end, a second end and an inward lip; and a connector body configured to engage the post and receive the coaxial cable, when the connector is in an assembled state, the connector body including:

an integral body biasing element having a coupling element contact portion extending from the connector body and configured to contact the coupling element when the connector is in the assembled state; and an annular groove configured to allow the integral body biasing element to deflect along an axial direction;

wherein the integral body biasing element is configured to exert a biasing force against the coupling element sufficient to axially urge the inward lip of the coupling element away from the connector body and toward the flange of the post at least until the post contacts the interface port as the coupling element is tightened on the interface port, so as to improve electrical grounding reliability between the coupling element and the post, even when the post is not in contact with the interface port.

2. The coaxial cable connector of claim 1, wherein the integral body biasing element includes a surface that extends a radial distance to engage the coupling element.

3. The coaxial cable connector of claim 1, wherein the integral body biasing element operates with the annular groove to permit deflection necessary to bias the coupling element against the post.

4. The coaxial cable connector of claim 2, wherein the surface of the integral body biasing element radially extends outward from a general axis of the connector past the inward lip of the coupling element, when the connector is in the assembled state.

5. The coaxial cable connector of claim 1, further including: a fastener member radially disposed over the connector body to radially compress the connector body onto the coaxial cable.

6. The coaxial cable connector of claim 1, wherein the integral body biasing element biases the inward lip of the coupling element against a surface of the flange of the post.

7. A method of improving electrical continuity through a coaxial cable connector, comprising:

providing a post having a first end, a second end, and a flange, wherein the post is configured to receive a center conductor surrounded by a dielectric of a coaxial cable;

operably attaching a coupling element to the post, the coupling element having a first end, a second end, and an inward lip having a contact surface extending along a radial direction and facing away from the flange of the post when the connector is in an assembled state;

providing a connector body having a first end, a second end, and an integral resilient biasing member having a contact portion extending from the connector body and toward the inward lip of the coupling element when the connector is in the assembled state, the integral resilient biasing member of the connector body being operable with an annular groove of the connector body to allow the integral resilient biasing member to deflect along an axial direction; and positioning the integral resilient biasing member of the connector body so that the integral resilient biasing member contacts the coupling element and exerts a biasing force on the coupling element in a direction toward the flange of the post urging the coupling element toward the flange of the post, when the connector is in the assembled state;

wherein the urging of the coupling element toward the flange of the post as the integral resilient biasing member exerts the biasing force against the coupling element improves electrical contact between the coupling element and the post.

8. The method of claim 7, wherein the integral resilient biasing member includes a surface that extends a radial distance outward beyond a radial extent of the inward lip of the coupling element.

9. The method of claim 7, wherein the integral resilient biasing member operates with the annular groove to permit deflection necessary to bias the coupling element against the post.

10. The method of claim 7, wherein the integral resilient biasing member of the connector body biases the inward lip of the coupling element against a surface of the flange of the post that faces the coupling element.

11. The coaxial cable connector of claim 1, wherein the integral body biasing element is configured to exert the biasing force against the coupling element so as to push the inward lip of the coupling element away from the connector body and toward the flange of the post at least until the post contacts the interface port when the coupling element is tightened on the interface port.

12. The coaxial cable connector of claim 1, wherein the integral body biasing element is configured to exert the biasing force against the coupling element so as to push the inward lip of the coupling element away from the connector body and toward the flange of the post before the post contacts the interface port when the coupling element is being tightened on the interface port.

13. The coaxial cable connector of claim 1, wherein the integral body biasing element is configured to exert the biasing force against the coupling element so as to push the inward lip of the coupling element away from the connector body and toward the flange of the post after the post contacts the interface port and after the coupling element is tightened on the interface port.

14. The coaxial cable connector of claim 1, wherein the connector body has a one-piece construction.

15. The coaxial cable connector of claim 1, wherein the biasing force exerted against the coupling element is greater than a separation force exerted against the coupling element or the post to try to form the electrical grounding gap between an inward lip of the coupling element and the flange of the post.

16. The coaxial cable connector of claim 1, wherein the inward lip protrudes inwardly.

17. The coaxial cable connector of claim 1, wherein when a separation force is exerted so as to try to push the coupling element and the post away from one another, the biasing force prevents an electrical grounding continuity interruption between the coupling element and the post when the biasing force is greater than the separation force.

18. The coaxial cable connector of claim 1, wherein the biasing force exerted against the coupling element is greater than a separation force exerted against the coupling element or the post to try to form an electrical grounding gap between the inward lip of the coupling element and the flange of the post.

19. The coaxial cable connector of claim 1, wherein the biasing force exerted against the coupling element is greater than a separation force exerted against the coupling element or the post to try to form a physical gap between the inward lip of the coupling element and the flange of the post.

20. The coaxial cable connector of claim 1, wherein the biasing force exerted against the coupling element is greater than a separation force.

21. The coaxial cable connector of claim 1, wherein an electrical grounding interruption is formed when a separation force exerted between the coupling element and the post is greater than the biasing force.

22. The coaxial cable connector of claim 1, wherein an electrical grounding interruption is formed when a separation force is greater than the biasing force so as to separate the coupling element and the post.

23. The coaxial cable connector of claim 1, wherein an electrical grounding interruption is not formed when a separation force is less than the biasing force so as to separate the coupling element and the post.

24. The coaxial cable connector of claim 1, wherein when a connector component separation force is greater than the biasing force, an electrical grounding interruption is formed between the coupling element and the post.

25. The coaxial cable connector of claim 1, wherein when a connector component separation force is less than the biasing force, an electrical grounding interruption is not formed between the coupling element and the post.

26. The coaxial cable connector of claim 1, wherein the biasing force comprises a spring force.

27. The coaxial cable connector of claim 1, wherein the biasing force comprises a constantly applied spring force when the coupling element is threaded on the interface port.

28. The coaxial cable connector of claim 1, wherein the biasing force comprises a constantly applied spring force when the coupling element is not fully tightened on the interface port.

29. The coaxial cable connector of claim 1, wherein the integral body biasing element is configured to exert the biasing force against the coupling element so as to push the inward lip of the coupling element away from the connector body and toward the flange of the post at least until the post contacts the interface port when the coupling element is threaded on the interface port.

30. The coaxial cable connector of claim 26, wherein the integral body biasing element is configured to exert the spring force against the coupling element so as to push the inward lip of the coupling element away from the connector body and toward the flange of the post at least until the post contacts the interface port when the coupling element is threaded on the interface port.

31. The coaxial cable connector of claim 1, wherein the integral body biasing element is configured to exert the biasing force against the coupling element so as to prevent a continuity interrupting gap from forming between the inward lip of the coupling element and the flange of the post when the coupling element is not fully tightened on the interface port.

32. The coaxial cable connector of claim 31, wherein the biasing force prevents the continuity interrupting gap from forming between the inward lip of the coupling element and the flange of the post when the biasing force exerted against the coupling element is greater than a separation force exerted against the coupling element or the post to try to form the continuity interrupting gap.

33. The coaxial cable connector of claim 1, wherein the integral body biasing element is configured to exert the biasing force against the coupling element so as to prevent a ground continuity interruption from occurring when the coupling element is not fully tightened on the interface port.

34. The coaxial cable connector of claim 33, wherein the biasing force prevents the ground continuity interruption from occurring when the biasing force exerted against the coupling element is greater than a separation force exerted against the coupling element or the post to try to form the continuity interrupting gap.

35. The coaxial cable connector of claim 33, wherein the ground continuity interruption occurs when a ground path between the coupling element and the post is directly or indirectly interrupted.

36. The coaxial cable connector of claim 33, wherein the ground continuity interruption occurs when the coupling element and the post are not in direct electrical contact with one another.

37. The coaxial cable connector of claim 33, wherein the ground continuity interruption occurs when the coupling element and the post are not in indirect electrical contact with one another.

38. The coaxial cable connector of claim 33, wherein the ground continuity interruption occurs when the coupling element and the post are not indirectly electrically coupled to one another.

39. The coaxial cable connector of claim 1, wherein the integral body biasing element is configured to exert the biasing force against the coupling element so as to prevent an electrical grounding gap from forming between the inward lip of the coupling element and the flange of the post when the coupling element is not fully tightened on the interface port.

40. The coaxial cable connector of claim 39, wherein the biasing force prevents the electrical grounding gap from forming between the inward lip of the coupling element and the flange of the post when the biasing force exerted against the coupling element is greater than a separation force exerted against the coupling element or the post to try to form the electrical grounding gap.

41. The coaxial cable connector of claim 1, wherein the integral body biasing element comprises a single unitary structure.

42. The coaxial cable connector of claim 1, wherein the integral body biasing element comprises a resilient portion.

43. The coaxial cable connector of claim 42, wherein the resilient portion is configured to flex between an undeformed state and a deformed state.

44. The coaxial cable connector of claim 42, wherein the resilient portion is configured to flex between an original shape and a deformed shape.

45. The coaxial cable connector of claim 42, wherein the resilient portion has an original shape and is configured to return to its original shape after being flexed.

46. The coaxial cable connector of claim 42, wherein the resilient portion has an original shape and is configured to return to its original shape after being depressed.

47. The coaxial cable connector of claim 42, wherein the resilient portion has an original shape and is configured to return to its original shape after being deformed.

48. The coaxial cable connector of claim 42, wherein the resilient portion is configured to regain its original position after being compressed.

49. The coaxial cable connector of claim 42, wherein the resilient portion is configured to regain its original position after being flexed.

50. The coaxial cable connector of claim 42, wherein the resilient portion is not configured to be permanently deformed.

51. The coaxial cable connector of claim 1, wherein the integral body biasing element is configured to extend an axial distance toward a forward direction.

52. The coaxial cable connector of claim 1, wherein the integral body biasing element is configured to extend along an axial distance toward a forward direction.

53. The coaxial cable connector of claim 1, wherein the integral body biasing element is configured to deflect along an axial distance.

54. The coaxial cable connector of claim 1, wherein the connector body includes a body portion and the integral body biasing element is configured to extend from the body portion.

55. The coaxial cable connector of claim 1, wherein the connector body includes a body portion and the integral body biasing element is configured to extend from the body portion toward a forward direction.

56. The coaxial cable connector of claim 1, wherein the connector body includes a body portion and the integral body biasing element includes a surface configured to extend from the body portion along a generally axial direction and along a generally radial direction.

57. The coaxial cable connector of claim 1, wherein the integral body biasing element is configured to move in the axial direction.

58. The coaxial cable connector of claim 57, wherein the axial direction is not limited to a perfectly axial direction.

59. The coaxial cable connector of claim 1, wherein the integral body biasing element is not configured to deflect only along the axial direction.

60. The coaxial cable connector of claim 1, wherein the integral body biasing element is configured to deflect in a generally axial direction.

61. The coaxial cable connector of claim 1, wherein the integral body biasing element is configured to axially flex.

62. The coaxial cable connector of claim 1, wherein the integral body biasing element is configured to axially and radially deflect.

63. The coaxial cable connector of claim 1, wherein the integral body biasing element is configured to move between a first position and a second position axially spaced from the first position.

64. The coaxial cable connector of claim 1, wherein the integral body biasing element is configured to pivot between a first position and a second position spaced from the first position.

65. The coaxial cable connector of claim 1, wherein the annular groove comprises a ring-shaped channel formed by the connector body.

66. The coaxial cable connector of claim 1, wherein the annular groove has a V-shape.

67. The coaxial cable connector of claim 1, wherein the annular groove is not limited to a V-shaped groove.

68. The coaxial cable connector of claim 1, wherein the annular groove comprises a channel extending around at least a portion of the connector body.

69. The coaxial cable connector of claim 1, wherein the integral body biasing element is configured to be deflected toward and away from the annular groove.

70. The coaxial cable connector of claim 1, wherein the integral body biasing element is configured to be deflected toward the annular groove when a force exerted against the integral body biasing element is greater than the biasing force exerted by the integral body biasing element against the coupling element.

71. The coaxial cable connector of claim 1, wherein the integral body biasing element is configured to improve electrical grounding reliability by maintaining a reliable ground path through the coupling element and the post.

72. The coaxial cable connector of claim 1, wherein the integral body biasing element is configured to improve electrical grounding reliability by maintaining a reliable ground path through the coupling element and the post when the biasing force prevents a grounding interruption from occurring.

73. The coaxial cable connector of claim 1, wherein the integral body biasing element is configured to improve electrical grounding reliability by maintaining a reliable ground path through the coupling element and the post when the biasing force prevents a grounding interruption from occurring either directly or indirectly between the coupling element and the post.

74. The coaxial cable connector of claim 1, wherein the coupling element includes an inward facing coupling element surface, the post includes an outward facing post surface, and the inward facing coupling element surface and the outward facing post surface are configured to form a gap between the inward facing coupling element surface and the outward facing post surface when the connector is in the assembled state.

75. The coaxial cable connector of claim 74, wherein the integral body biasing element is configured to exert the biasing force against the coupling element so as to urge the inward lip of the coupling element away from the connector body and toward the flange of the post without closing the gap formed between the inward facing coupling element surface and the outward facing post surface.

76. The coaxial cable connector of claim 74, wherein the biasing force urges the inward lip of the coupling element along the axial direction away from the connector body and toward the flange of the post.

77. The coaxial cable connector of claim 1, wherein the coupling element includes an inward facing coupling element surface, the post includes an outward facing post surface, and the inward facing coupling element surface and the outward facing post surface are configured to form an annular space when the connector is in the assembled state.

78. The coaxial cable connector of claim 77, wherein the integral body biasing element is configured to exert the biasing force against the coupling element so as to urge the inward lip of the coupling element away from the connector body and toward the flange of the post without closing the annular space formed between the inward facing coupling element surface and the outward facing post surface.

79. The coaxial cable connector of claim 1, wherein sufficient to axially urge the inward lip of the coupling element away from the connector body and toward the flange of the post comprises exerting an adequate amount of force necessary to push the inward lip of the coupling element in a direction toward the flange of the post.

80. The coaxial cable connector of claim 1, wherein the inward lip comprises an inward protrusion of the coupling element.

81. The coaxial cable connector of claim 1, wherein the inward lip comprises a protrusion of the coupling element that extends inwardly along a radial distance.

82. The coaxial cable connector of claim 1, wherein the coupling element includes an inward facing surface and the inward lip comprises a protrusion of the coupling element that extends inwardly from the inward facing surface.

83. The coaxial cable connector of claim 1, wherein the coupling element includes an inward facing surface and the inward lip comprises a protrusion of the coupling element that extends inwardly along a radial distance away from the inward facing surface.

84. The coaxial cable connector of claim 1, wherein the inward lip of the coupling element is configured to movably couple the coupling element to the post while allowing the coupling element to rotate when the connector is in an assembled state.

85. The coaxial cable connector of claim 1, wherein the inward lip of the coupling element is configured to movably couple the coupling element to the post without preventing the coupling element from rotating when the connector is in an assembled state.

86. The coaxial cable connector of claim 1, wherein the inward lip of the coupling element is configured to engage the flange of the post so as to prevent axial movement of the coupling element relative to the post without preventing the coupling element from rotating when the connector is in an assembled state.

87. The coaxial cable connector of claim 1, wherein the coupling element includes an inward facing coupling element surface, the inward lip comprises an inward protrusion of the coupling element that extends inward from the inward facing coupler surface, the post includes an outward facing post surface, and the flange of the post comprises an outward protrusion of the post that extends outward from the outward facing post surface.

88. The coaxial cable connector of claim 87, wherein the inward protrusion of the coupling element is configured to engage the outward protrusion of the post so as to prevent axial movement of the coupling element relative to post without preventing the coupling element from rotating when the connector is in an assembled state.

89. The coaxial cable connector of claim 1, wherein the post comprises a component of the connector that is configured to make electrical contact with a conductive grounding shield of the coaxial cable and the interface port when the connector is fully tightened on the interface port.

90. The coaxial cable connector of claim 1, wherein the integral body biasing element is made of a non-metallic and non-conductive material.

91. The coaxial cable connector of claim 1, wherein the integral body biasing element includes a non-metallic and non-conductive material.

92. The coaxial cable connector of claim 1, wherein the integral body biasing element is made of a material that is not limited to a fully non-metallic and non-conductive material.

93. The coaxial cable connector of claim 1, wherein the integral body biasing element is made of a combination of conductive and non-conductive materials.

94. The coaxial cable connector of claim 1, wherein the integral body biasing element is configured to help prevent a gap between the coupling element and the post from allowing electrical grounding continuity to be interrupted by maintaining an electrical connection between the coupling element and the connector body when the connector is in the assembled state and even when the post is not in contact with the interface port.

95. The coaxial cable connector of claim 1, wherein the integral body biasing element is configured to help prevent electrical grounding continuity from being interrupted by maintaining an electrical connection between the coupling element and the connector body when the connector is in the assembled state and even when the post is not in contact with the interface port.

96. The coaxial cable connector of claim 1, wherein the connector is in the assembled state when the coupling element is threaded on the interface port.

97. The coaxial cable connector of claim 1, wherein the connector is in the assembled state when the coupling element is tightened on the interface port.

98. The coaxial cable connector of claim 1, wherein the connector is in the assembled state when the post receives the coaxial cable.

99. The coaxial cable connector of claim 1, wherein the connector is in the assembled state when the post receives the coaxial cable and when the coupling element is threaded on the interface port.

100. The coaxial cable connector of claim 1, wherein the connector is in the assembled state when the coupling element is fully tightened onto the interface port.

101. The coaxial cable connector of claim 1, wherein the connector is in the assembled state when the coupling element is loosely tightened onto the interface port.

102. The coaxial cable connector of claim 1, wherein the connector is in the assembled state when the post is not in contact with the interface port.

103. The coaxial cable connector of claim 1, wherein the coupling element and the post are configured to move relative to one another when the connector is in the assembled state.

104. The coaxial cable connector of claim 103, wherein the coupling element and the post are configured to rotate relative to one another when the connector is in the assembled state.

105. The coaxial cable connector of claim 103, wherein the coupling element and the post are configured to axially move relative to one another when the connector is in the assembled state.

106. A connector comprising:

a post member having an outward flange projection, the post member being configured to at least partially receive a coaxial cable;

a coupling member configured to engage the post member to move between a first position, where the post member does not contact an interface port, and a second position, where the post member contacts the interface port, the second position being axially spaced from the first position, the coupling member having an inward lip projection; and a body member configured to engage the post member and receive the coaxial cable, when the connector is in an assembled state, the body member including:

an integral body biasing element having a coupling member contact portion configured to contact the coupling member when the connector is in the assembled state; and an annular groove configured to allow the integral body biasing element to deflect along an axial direction; and wherein the integral body biasing element is configured to exert a biasing force toward the coupling member to axially urge the inward lip projection of the coupling member away from the body member and toward the outward flange projection of the post member at least until the post member contacts the interface port when the coupling member is tightened on the interface port, so as to maintain electrical grounding reliability between the coupling member and the post member, even when the post member is not in contact with the interface port.

107. The connector of claim 106, wherein the body member includes a base portion and the integral body biasing element extends away from the base portion to engage the coupling member when the connector is in the assembled state.

108. The connector of claim 106, wherein the annular groove is shaped to allow the integral body biasing portion to deflect so as to bias the coupling member toward the post member.

109. The connector of claim 106, wherein the integral body biasing element includes a surface that extends outward from a general axis of the connector past the inward lip projection of the coupling member when the connector is in the assembled state.

110. The connector of claim 106, wherein the integral body biasing element causes the inward lip projection of the coupling member to be biased against the outward flange projection of the post member when the connector is in the assembled state.

111. The connector of claim 106, wherein the integral body biasing element biases the inward lip projection of the coupling member against a surface of the outward flange projection of the post member.

112. The connector of claim 106, wherein the biasing force exerted against the coupling member is greater than a separation force exerted against the coupling member or the post member to try to form a continuity interrupting gap between the inward lip projection of the coupling member and the outward flange projection of the post member.

113. The connector of claim 106, wherein when a separation force is exerted between the coupling member and the post member away from one another, the biasing force prevents an electrical grounding continuity interruption between the coupling member and the post member when the biasing force is greater than the separation force.

114. The connector of claim 106, wherein the biasing force comprises a spring force.

115. The connector of claim 106, wherein the biasing force comprises a constantly applied spring force when the coupling member is threaded on the interface port.

116. The connector of claim 106, wherein the biasing force comprises a constantly applied spring force when the coupling member is not fully tightened on the interface port.

117. The connector of claim 106, wherein the integral body biasing element is configured to exert the biasing force against the coupling member so as to prevent a continuity interrupting gap from forming between the inward lip projection of the coupling member and the outward flange projection of the post member when the coupling member is not fully tightened on the interface port.

118. The connector of claim 117, wherein the biasing force prevents the continuity interrupting gap from forming between the inward lip projection of the coupling member and the outward flange projection of the post member when the biasing force exerted against the coupling member is greater than a separation force exerted against the coupling member or the post member to try to form the continuity interrupting gap.

119. The connector of claim 106, wherein the integral body biasing element is configured to exert the biasing force against the coupling member so as to prevent a ground continuity interruption from occurring when the coupling member is not fully tightened on the interface port.

120. The connector of claim 119, wherein the ground continuity interruption occurs when a ground path between the coupling member and the post member is directly or indirectly interrupted.

121. The connector of claim 119, wherein the ground continuity interruption occurs when the coupling member and the post member are not in direct electrical contact with one another.

122. The connector of claim 119, wherein the ground continuity interruption occurs when the coupling member and the post member are not in indirect electrical contact with one another.

123. The connector of claim 119, wherein the ground continuity interruption occurs when the coupling member and the post member are no longer electrically coupled to one another.

124. The connector of claim 106, wherein the integral body biasing element comprises a single unitary structure.

125. The connector of claim 106, wherein the integral body biasing element comprises a resilient portion.

126. The connector of claim 125, wherein the resilient portion is configured to flex between an undeformed state and a deformed state.

127. The connector of claim 125, wherein the resilient portion is configured to flex between an original shape and a deformed shape.

128. The connector of claim 125, wherein the resilient portion has an original shape and is configured to return to the original shape after being deformed.

129. The connector of claim 106, wherein the integral body biasing element is configured to deflect along an axial distance.

130. The connector of claim 106, wherein the body member includes a body portion and the integral body biasing element is configured to extend from the body portion toward a forward direction.

131. The connector of claim 106, wherein the axial direction is not limited to a perfectly axial direction.

132. The connector of claim 106, wherein the integral body biasing element is not configured to deflect only along the axial direction.

133. The connector of claim 106, wherein the integral body biasing element is configured to move between a first position and a second position axially spaced from the first position.

134. The connector of claim 106, wherein the integral body biasing element is configured to pivot between a first position and a second position spaced from the first position.

135. The connector of claim 106, wherein the annular groove comprises a ring-shaped channel formed by the body member.

136. The connector of claim 106, wherein the annular groove has a V-shape.

137. The connector of claim 106, wherein the annular groove is not limited to a V-shaped groove.

138. The connector of claim 106, wherein the annular groove comprises a channel extending around at least a portion of the body member.

139. The connector of claim 106, wherein the integral body biasing element is configured to be deflected toward the annular groove when a force exerted against the integral body biasing element is greater than the biasing force exerted by the integral body biasing element against the coupling member.

140. The connector of claim 106, wherein the integral body biasing element is configured to improve electrical grounding reliability by maintaining a reliable ground path through the coupling member and the post member.

141. The connector of claim 106, wherein the integral body biasing element is configured to improve electrical grounding reliability by maintaining a consistent ground path through the coupling member and the post member when the biasing force prevents a grounding interruption from occurring.

142. The connector of claim 106, wherein the coupling member includes an inward facing coupling member surface, the post member includes an outward facing post surface, and the inward facing coupling member surface and the outward facing post surface are configured to form a space between the inward facing coupling member surface and the outward facing post surface when the connector is in the assembled state.

143. The connector of claim 142, wherein the integral body biasing element is configured to exert the biasing force against the coupling member so as to urge the inward lip projection of the coupling member away from the body member and toward the outward flange projection of the post member without closing the space formed between the inward facing coupling member surface and the outward facing post surface.

144. The connector of claim 106, wherein the biasing force pushes the inward lip projection of the coupling member along an axial direction away from the body member and toward the outward flange projection of the post member without closing a space formed between the inward facing coupling member surface and the outward facing post surface when the connector is in the assembled state.

145. The connector of claim 106, wherein the integral body biasing element is configured to exert the biasing force against the coupling member so as to urge the inward lip projection of the coupling member away from the body member and toward the outward flange projection of the post member without closing an annular space formed between the inward facing coupling member surface and the outward facing post surface.

146. The connector of claim 106, wherein the inward lip projection of the coupling member is configured to movably couple the coupling member to the post member without preventing the coupling member from rotating when the connector is in an assembled state.

147. The connector of claim 106, wherein the inward lip projection of the coupling member is configured to engage the outward flange projection of the post member so as to prevent axial movement of the coupling member relative to the post member without preventing the coupling member from rotating when the connector is in an assembled state.

148. The connector of claim 106, wherein the post member comprises a component of the connector that is configured to make electrical contact with a conductive grounding shield of the coaxial cable and the interface port when the connector is fully tightened on the interface port.

149. The connector of claim 106, wherein the integral body biasing element is made of a non-metallic and non-conductive material.

150. The connector of claim 106, wherein the integral body biasing element is made of a material that is not limited to a fully non-metallic and fully non-conductive material.

151. The connector of claim 106, wherein the integral body biasing element is made of a combination of conductive and non-conductive materials.

152. The connector of claim 106, wherein the connector is in the assembled state when the coupling member is threaded on the interface port.

153. The connector of claim 106, wherein the connector is in the assembled state when the coupling member is tightened on the interface port.

154. The connector of claim 106, wherein the connector is in the assembled state when the post member receives the coaxial cable.

155. The connector of claim 106, wherein the connector is in the assembled state when the post member receives the coaxial cable and when the coupling member is threaded on the interface port.

156. The connector of claim 106, wherein the connector is in the assembled state when the coupling member is fully tightened onto the interface port.

157. The connector of claim 106, wherein the connector is in the assembled state when the coupling member is loosely tightened onto the interface port.

158. The connector of claim 106, wherein the connector is in the assembled state when the post member is not in contact with the interface port.

159. The connector of claim 106, wherein the coupling member and the post member are configured to move relative to one another when the connector is in the assembled state.

* * * * *